US009207617B2

(12) United States Patent
Okamoto

(10) Patent No.: US 9,207,617 B2
(45) **Date of Patent: *Dec. 8, 2015**

(54) SHEET TRANSFER APPARATUS AND IMAGE FORMING APPARATUS

(75) Inventor: Naoyuki Okamoto, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 1504 days.

This patent is subject to a terminal disclaimer.

(21) Appl. No.: 12/320,203

(22) Filed: Jan. 21, 2009

(65) Prior Publication Data

US 2009/0185846 A1 Jul. 23, 2009

(30) Foreign Application Priority Data

Jan. 22, 2008 (JP) ..... 2008-011711

(51) Int. Cl.

| | |
|---|---|
| ***B65H 5/00*** | (2006.01) |
| ***G03G 15/00*** | (2006.01) |
| ***B65H 5/26*** | (2006.01) |
| ***B65H 5/38*** | (2006.01) |

(52) U.S. Cl.

CPC ..... *G03G 15/6529* (2013.01); *B65H 5/26* (2013.01); *B65H 5/38* (2013.01); *B65H 2301/4454* (2013.01); *B65H 2402/5441* (2013.01); *B65H 2801/06* (2013.01)

(58) Field of Classification Search

CPC .... B65H 2301/4454; B65H 5/38; B65H 5/26; B65H 5/025; B65H 5/36; B65H 2404/5214; B65H 2404/513; B65H 2402/5441

USPC ..... 399/388, 381, 391, 392; 271/9.13, 264

IPC ..... B65H 3/44

See application file for complete search history.

(56) References Cited

U.S. PATENT DOCUMENTS

| | | | | |
|---|---|---|---|---|
| 6,227,533 | B1 * | 5/2001 | Jang | 271/109 |
| 2002/0089112 | A1 * | 7/2002 | Middelberg et al. | 271/9.13 |
| 2005/0074266 | A1 * | 4/2005 | Hiramoto et al. | 399/391 |
| 2006/0180989 | A1 * | 8/2006 | Seike et al. | 271/121 |
| 2007/0057444 | A1 | 3/2007 | Sagawa et al. | |

(Continued)

FOREIGN PATENT DOCUMENTS

| | | | |
|---|---|---|---|
| EP | 485098 | A1 * | 5/1992 |
| JP | 1-62231 | | 4/1989 |

(Continued)

OTHER PUBLICATIONS

Office Action for corresponding Japanese patent application No. 2008-011711 dated Jun. 12, 2012.

*Primary Examiner* — Jennifer Simmons

(74) *Attorney, Agent, or Firm* — Harness, Dickey & Pierce, P.L.C.

(57) ABSTRACT

A disclosed apparatus includes a first unit upstream of a first path to transfer a sheet; a second unit upstream of a second path to transfer another sheet from opposite side of the first path; a third unit on a combined path of the first and second paths to transfer the sheets downstream; and a first member provided where the first and second paths meet to guide the sheets to the combined path. The third unit is a nip unit including elements forming a nip. One of the elements on the second path side is a belt unit. The first member has a downstream edge extending in a sheet width direction. The downstream edge has a first part facing the nip part and a second part not facing the nip part. The second part is located downstream of the first part in the sheet transfer direction.

10 Claims, 22 Drawing Sheets

(56) References Cited

U.S. PATENT DOCUMENTS

| | | | |
|---|---|---|---|
| 2007/0246879 | A1 | 10/2007 | Sagawa et al. |
| 2008/0038039 | A1 | 2/2008 | Watase et al. |

FOREIGN PATENT DOCUMENTS

| | | | | | |
|---|---|---|---|---|---|
| JP | 2-119467 | | 9/1990 | | |
| JP | 04-217539 | | 8/1992 | | |
| JP | 7-094293 | | 4/1995 | | |
| JP | 10-129883 | | 5/1998 | | |
| JP | 2004-338923 | | 12/2004 | | |
| JP | 2005-001771 | | 1/2005 | | |
| JP | 2005-089008 | | 4/2005 | | |
| JP | 2007106551 | A * | 4/2007 | ..... | B65H 5/38 |
| JP | 2008-037587 | | 2/2008 | | |
| JP | 2008-207922 | | 9/2008 | | |

* cited by examiner

Related Art

Related Art

Related Art

Related Art

Related Art

Related Art

Related Art

SHEET TRANSFER APPARATUS AND IMAGE FORMING APPARATUS

BACKGROUND OF THE INVENTION

1. Field of the Invention

The present invention relates to an image forming apparatus such as a sheet transfer apparatus, a multifunction peripheral such as an electrophotographic multifunction peripheral having the sheet transfer apparatus, a facsimile machine, a printer such as a laser printer, a printing machine such as a stencil printing machine, an inkjet recording apparatus, or a multifunction peripheral formed of a combination of at least two of these apparatuses, and the like.

2. Description of the Related Art

There has been a growing need for downsizing image forming apparatuses such as multifunction peripherals including PPCs (Plain Paper Copiers) such as electrophotographic multifunction peripherals, facsimile machines, printers including laser printers, printing machines such as stencil printing machines, and multifunction peripherals formed of a combination of at least two of these apparatuses. In order to downsize these apparatuses, there is a tendency of downsizing transfer units for transferring and supplying a medium subject to imaging, which is a medium on which the image is formed or a recording medium in a sheet form (hereinafter also referred to as a "sheet") from a sheet storage unit or a sheet stacking unit on which the sheets are stacked, to an image forming unit body.

As plural paper feed units and sheet transfer apparatuses which serve as a sheet feed unit provided in or connected to the image forming apparatus, for example, there is known an apparatus including a first transfer path through which a sheet is transferred, a second transfer path through which a sheet is transferred from an opposite side of the first transfer path, and a combined transfer path into which the first transfer path and the second transfer path merge (for example, see Patent Documents 1, 3, and 4). The first transfer path (hereinafter also called a first transfer channel) is, for example, generally provided in a sheet transfer apparatus in a plural-stage paper feed unit, which is also called a bank paper feed unit provided in an apparatus body. The second transfer path (hereinafter also called a second transfer channel) is, for example, provided on one side of the apparatus body. The second transfer path is generally provided or connected to a manual paper feed unit for supplying a relatively small number of sheets of various types in various sizes, or connected to a large amount paper feed unit or a large quantity paper feed unit for feeding a large number of sheets of, for example, thousands or more.

In image forming apparatuses including plural paper feed units and sheet transfer apparatuses with such a layout, the combined transfer path is generally provided for downsizing particularly a width direction of the apparatus body when a user faces and operates the apparatus in various ways, such as by supplying sheets. That is, the combined transfer path is normally provided to downsize a horizontal direction of the apparatus body when seen from a user facing the apparatus body. A technique to provide the combined transfer path is hereinafter called a "former technique".

On the other hand, image forming apparatuses are generally compatible with various sheet sizes (hereinafter called "paper sizes" as an example) and sheet types (hereinafter called "paper types" as an example). In such image forming apparatuses, for example, paper in various sizes and types are stored in advance in a sheet storage unit. The paper is fed from the sheet storage unit selected by a user or the paper is automatically selected and fed by the image forming apparatus. In such a system, since the sheet storage unit occupies a large area in the image forming apparatus, the transfer unit is further required to be downsized.

In view of these, a transfer path provided between a sheet storage unit and an image forming unit body in the image forming apparatus has a transfer direction largely changed so as to reduce the occupying area, though depending on a positional relationship between the sheet storage unit and the image forming unit body. The transfer path is formed to have a curved part in order to change the transfer direction continuously and smoothly. A curvature radius of this curved part is set relatively small so that standard recording paper normally used in the image forming apparatus can be transferred.

As a sheet transfer apparatus in such an image forming apparatus, for example, there is a conventional technique disclosed in Patent Document 1. That is, as shown in FIGS. 6 and 7 of Patent Document 1, a paper feed tray is provided on a lower side of the image forming unit body. The paper feed tray serves as a sheet storage unit in which a predetermined number of sheets in predetermined sizes or types are stacked in corresponding stages. A sheet transfer apparatus capable of drawing one sheet in a substantially horizontal direction of the paper feed tray in the selected stage and feeding the sheet to the image forming unit body on an upper side is provided between the paper feed tray and the image forming unit body.

Hereinafter, description is made with reference to Patent Document 1. Reference numerals in each drawing of Patent Document 1 are described in parenthesis. A sheet (P) in a paper feed tray (1) is separated one by one by a known FRR separation method and transferred through a transfer path having a curved part which is formed of an upper guide board (8) and a lower guide board (7), and to an image forming unit body. The curved part is formed of a curve fixing guide member formed of the upper guide board (8) and the lower guide board (7). The sheet (P) passes through the curved part along the lower guide board (7). As the sheet (P) is transferred, the sheet (P) is pressed and adjusted in its transfer path by the upper guide board (8). The sheet (P) is transferred along a guide piece (6) capable of elastic deformation, which is located at an exit of the lower guide board (7), and reaches a pair of transfer rollers (5). Hereinafter, the upper guide board (8) and the lower guide board (7) are called the "curve fixing guide member".

When a sheet (P) such as special paper having a high stiffness, including an envelope or recording paper such as thick paper is transferred in a sheet transfer apparatus having the aforementioned configuration, since a curvature radius of the curved part of the transfer path is small, resistance caused when the sheet (P) is bent and transferred along the curvature is much higher than resistance of a sheet such as normal paper for copying. Therefore, there is a problem in that the sheet (P) such as recording paper and special paper with high stiffness cannot be transferred and a paper jam or a transfer defect is caused.

This operation is described more specifically below. When a leading edge (leading edge side) of the sheet (P) in a transfer direction reaches the curve fixing guide member formed of the upper guide board (8) and the lower guide board (7), a front half part of the sheet (P) on the leading edge side is bent in a direction of the thickness by this curve fixing guide member. Therefore, when the highly stiff sheet (P) is transferred, the sheet (P) has a large force resisting the curve. This force increases resistance that prevents the transfer of the sheet (P). Therefore, when the leading edge of the highly stiff sheet (P) does not reach the pair of transfer rollers 5 on the downstream side and the sheet (P) is transferred by only a pair of rollers (2a and 2b) on the upstream side, and the sheet (P)

is bent by the curve fixing guide member, a transfer force of only the pair of rollers (2a and 2b) is not enough to transfer the sheet (P) in the transfer direction against the resistance force of the bent sheet (P). As a result, transfer defects may be caused such as skewing of the highly stiff sheet (P), in which a center line of the sheet (P) is not aligned with the center line of the transfer path. Moreover, a paper jam is easily caused, in which the highly stiff sheet (P) is stuck within the curve fixing guide member and seized.

In view of this, Patent Document 1 discloses a paper feed apparatus in which a sheet transferred by a first transfer unit is transferred to a second transfer unit located on a downstream side of a transfer direction and substantially vertically above the first transfer unit. A pair of straight guiding members is provided between the first transfer unit and the second transfer unit, by which a sheet is guided and transferred. In this paper feed apparatus, the guiding members are not curved but formed straight, therefore, a transfer load can be suppressed low. That is, since a rapid rise of the transfer load can be prevented, transfer defects such as a paper jam and skewing of paper can be prevented.

According to this paper feed apparatus, in other words, the transferred sheet is not bent only at one point by the curve guiding member but two points in the vicinity of front and rear edges of the straight guiding members. Moreover, by providing the straight guiding members to be inclined at a substantially medium angle, curves caused by the two points are made substantially equal to each other. In this manner, a rapid rise of a transfer load can be suppressed when the sheet is transferred. That is, to change the transfer direction of the sheet, the sheet is curved at two points: a point where the sheet is sent from the pair of rollers on the upstream side to the straight guiding members and a point where the sheet is sent from the straight guiding members to the pair of rollers on the downstream side. Therefore, at least the curvature of each point can be relatively small. In addition, the resistance caused by the curve at each point can be suppressed low. As a result, a rapid rise of the transfer load can be avoided.

There is known a paper feed apparatus (for example, see Patent Document 2) including first and second transfer units configured similarly to Patent Document 1; and an inversion guiding member serving as a sloped surface leading to the second transfer unit, which is provided between the first and second transfer units. This inversion guiding member is configured movable toward the second transfer unit (for example, see Patent Document 2).

According to this paper feed apparatus, when a rear edge of paper contacts the inversion guiding member, the inversion guiding member is displaced in a direction that is generally the same as a direction that the rear edge contacts the inversion guiding member. By this displacement, a shock caused by the contact of the rear edge of the paper can be absorbed. As a result, a noise made by the flipping of the paper can be reduced.

Moreover, there is known a sheet feeding apparatus (for example, see Patent Document 3) including plural sheet storage units which store sheets, and a transfer path and a sheet feeding unit provided for each sheet storage unit. Ends of these transfer paths merge into one common transfer path. In at least the transfer path provided for the sheet storage unit which stores highly stiff sheets, a curvature radius of a first curved part formed at an end of the transfer path, which is to be merged to the common transfer path, is larger than a curvature radius of another curved part of another transfer path, which is combined to the common transfer path.

According to this sheet feeding apparatus, when a highly stiff sheet is transferred through the first curved part with the large curvature radius on the transfer path, the highly stiff sheet is not curved as much as a normal sheet. The highly stiff sheet is curved moderately enough as compared to the normal sheet when transferred. Therefore, resistance caused when transferring the highly stiff sheet can be reduced and the sheet can reach the common transfer path without causing a paper jam or a transfer delay.

Further, there is known a sheet inverting unit (for example, see Patent Document 4) provided in an image forming apparatus. The sheet inverting unit includes a pair of inverting rollers and an inversion transfer path for transferring and guiding a sheet sent by the pair of inverting rollers. The inversion transfer path has a direction changing member for changing a transfer direction of the sheet. By providing rotatable rollers inside the direction changing member in a vertical direction to the sheet transfer direction, the sheet sent to the inversion transfer path is contacted by the rollers and transferred.

According to this sheet inverting unit, an inside surface of the sheet necessarily contacts the rollers in the direction changing member. Moreover, since these rollers rotate following the transfer of the sheet, transfer resistance can be reduced compared to a conventional guiding board. That is, a transfer direction of the sheet can be changed in the direction changing member, without generating friction resistance between a fixed guiding member and a moving sheet.

Patent Documents 1 to 4 are hereinafter described as "latter techniques".

The former technique, however, has a problem in that various types of sheets in various sizes cannot be transferred with stable transfer quality from the first and/or the second transfer path while realizing downsizement and compactness of a width of the apparatus, which has been demanded these years in particular.

The latter techniques, on the other hand, have the following defects. That is, since the sheet transfer apparatus disclosed in Patent Document 1 has a configuration having a fixed member provided for guiding a transferred sheet, there is always a difference in speed between the transferred sheet as a moving object and the fixed guiding member. Regardless of the shape or position of the guiding member, there is always resistance to disturb the transfer of the sheet between the sheet and the guiding member, which becomes a transfer load.

That is, by the conventional configuration, a sufficient effect to avoid the transfer defect or paper jam cannot be provided. Even if a rapid rise of the transfer load can be suppressed by the straight guiding member, the transfer load is generated in any way. When transferring highly stiff paper (sheet) such as thick paper and an envelope, in particular, the transfer defect, paper jam, and flipping noise of a rear edge of the paper are notably generated.

In the configuration having the inversion guiding member, which is disclosed in Patent Document 2, although the guiding member is displaceable in a direction in which the rear edge of the paper contacts, the inversion guiding member is a fixed guiding member to change the direction of the paper. Moreover, when the inversion guiding member guides the paper by changing the direction of the paper, a relative difference in speed between the paper and the inversion guiding member, which becomes a transfer load, is not eliminated. When highly stiff paper (sheet) such as thick paper and an envelope is transferred, in particular, the transfer defect, paper jam, and flipping noise of the rear edge of the paper are notably generated.

Further, by the configuration having the transfer path with a large curvature radius as in the technique disclosed in Patent Document 3, a sheet transferred on this transfer path is moderately curved. Although transfer resistance applied from the transfer path to the sheet is reduced, the transfer load is similarly generated more or less. When highly stiff paper (sheet) such as thick paper and an envelope is transferred, in particular, the transfer defect and paper jam are notably generated.

In the configuration having a movable member such as rollers in a predetermined position of inside the transfer path of the direction changing member as in the technique as disclosed in Patent Document 4, friction resistance between the sheet and the transfer path can be effectively reduced when an intermediate part between leading and rear edges of the sheet is supported by the rollers of inside. However, there is no countermeasure for a transfer load generated before and after the aforementioned state, that is when the sheet contacts outer sides of the transfer path of the direction changing member. Moreover, there is no particular description about the movement of the leading and rear edges of the sheet in the transfer process. When highly stiff paper (sheet) such as thick paper and an envelope is transferred, in particular, the transfer defect and paper jam are notably generated.

In view of this, the applicant has suggested a sheet transfer apparatus which can solve the defects of the latter techniques, an image forming apparatus having the sheet transfer device, and the like in Japanese Patent Application No. 2006-214779 (hereinafter called "a related Japanese application 1") filed on Aug. 7, 2006, and the like. The related Japanese application 1 includes a movement guiding unit (specifically a belt transfer unit) arranged in a direction of an outer surface of a sheet transfer path formed between first and second transfer paths, for moving and guiding a sheet to the second transfer unit. According to the related Japanese application 1 and the like, the sheet transfer apparatus which is compact, occupies less space, has a simple configuration at lower cost, and is highly compatible with various sheet types (paper types), an image reading apparatus having the sheet transfer apparatus, and an image forming apparatus having the sheet transfer apparatus and/or the image reading apparatus are provided.

Moreover, in applying related Japanese application 1 and the like to the sheet transfer apparatus and the image forming apparatus which have the combined transfer path to put these apparatuses into a practical use, the present applicant has applied Japanese Patent Application No. 2007-46215 filed on Feb. 26, 2007 (hereinafter called "a related Japanese application 2"). According to the related Japanese application 2, there are provided a sheet transfer apparatus, an image forming apparatus, and the like, in which various types of sheets in various sizes can be transferred from the first and/or second transfer path while downsizing the apparatus compared to the conventional apparatus, or in which various types of sheets can be transferred with stable transfer quality by forming one of the first and second transfer paths to have a large curvature radius with a similar apparatus width to the conventional apparatus. According to the related Japanese application 2, the sheet transfer apparatus includes a first transfer path through which a sheet is transferred, a second transfer path through which the sheet is transferred from an opposite side of the first transfer path, a combined transfer path into which the first and second transfer paths merge, and a belt transfer unit provided as an outer surface of the combined transfer path when seen from the first transfer path and an inner surface of the combined transfer path when seen from the second transfer path, that is on the second transfer path side.

According to the related Japanese application 2, various types of sheets in various sizes can be transferred from both of the first and second transfer paths while downsizing the apparatus compared to the conventional apparatus, or various types of sheets can be transferred with stable transfer quality with a similar apparatus width to the conventional apparatus and the curvature radius of one of the first and second transfer paths set large. Accordingly, design freedom can be expanded.

However, while performing tests to apply related Japanese application 2 to the sheet transfer apparatus having the combined transfer path and the image forming apparatus to put these apparatuses into a practical use, it was found that some improvements are required. Specifically, though described with reference to FIG. 10 below, on the downstream side of the first guiding member provided at a position where the first and second transfer paths meet and configured to guide the sheet transferred from the first and second transfer paths to the combined transfer path, opposite end portions of a leading edge of a relatively stiff sheet such as thick paper transferred from the second transfer path, in particular, generates waviness or sagging at both ends of the sheet width direction of the belt transfer unit outside a nip part of the sheet. Because of this, the sheet cannot be normally transferred and a paper jam and a transfer defect are caused. As a result, there is a problem in that a stable transfer operation cannot be performed.

[Patent Document 1] Japanese Patent Application Publication No. 2004-338923 (pages 1 to 3 and FIGS. 1 to 7)

[Patent Document 2] Japanese Patent Application Publication No. 2005-89008 (pages 2 and 3 and FIGS. 4 and 5)

[Patent Document 3] Japanese Patent Application Publication No. 10-129883 (pages 1 and 2 and FIG. 1)

[Patent Document 4] Japanese Patent Application Publication No. 2005-1771 (pages 1 and 2 and FIG. 1)

SUMMARY OF THE INVENTION

In view of these, it is an object of at least one embodiment of the present invention to provide a sheet transfer apparatus and an image forming apparatus according to related Japanese application 2, in which a paper jam and a transfer defect of a sheet with a relatively high stiffness transferred from the second transfer path are prevented in advance and a stable sheet transfer operation can be performed.

In addition, it is another object of at least one embodiment of the present invention to provide a sheet transfer apparatus with each claimed effect, and an image forming apparatus having the sheet transfer apparatus.

To solve the aforementioned problems and achieve the aforementioned objects, following units and configurations are employed in the present invention.

According to one aspect of the present invention, a sheet transfer apparatus includes a first transfer unit configured to transfer a sheet and provided on an upstream side of a first transfer path through which the sheet is transferred, a second transfer unit configured to transfer another sheet and provided on an upstream side of a second transfer path through which said another sheet is transferred from an opposite side of the first transfer path, a third transfer unit provided on a combined transfer path into which the first transfer path and the second transfer path merge, the third transfer unit being configured to transfer the sheet transferred from the first transfer path and said another sheet transferred from the second transfer path to a downstream side of the combined transfer path in a sheet transfer direction, and a first guiding member provided at a position where the first transfer path and the second transfer path meet, the first guiding member being configured to guide the sheet transferred from the first transfer path and said another sheet transferred from the second transfer path to the combined transfer path. The third transfer unit serves as a nip transfer unit formed of a pair of elements which form a nip part for nipping and transferring the sheet and said another sheet, one of the pair of elements on a side of the second transfer path being a belt transfer unit. The first guiding member has a downstream edge extending in a sheet width direction perpendicular to the sheet transfer direction. The downstream edge has a first edge part facing the nip part and a second edge part not facing the nip part. The second edge part is situated on a downstream side of the first edge part in the sheet transfer direction.

According to another aspect of the present invention, a sheet transfer apparatus includes a first transfer unit configured to transfer a sheet and provided on an upstream side of a first transfer path through which the sheet is transferred, a second transfer unit configured to transfer another sheet and provided on an upstream side of a second transfer path through which said another sheet is transferred from an opposite side of the first transfer path, a third transfer unit provided on a combined transfer path into which the first transfer path and the second transfer path merge, the third transfer unit being configured to transfer the sheet transferred from the first transfer path and said another sheet transferred from the second transfer path to a downstream side of the combined transfer path in a sheet transfer direction, and a first guiding member provided at a position where the first transfer path and the second transfer path meet. The first guiding member is configured to guide the sheet transferred from the first transfer path and said another sheet transferred from the second transfer path to the combined transfer path. The third transfer unit serves as a nip transfer unit formed of a pair of elements which form a nip part for nipping and transferring the sheet and said another sheet. One of the pair of elements on a side of the second transfer path is a belt transfer unit. The first guiding member has a downstream edge extending in a sheet width direction perpendicular to the sheet transfer direction. The downstream edge has a first edge part facing the nip part and a second edge part not facing the nip part. The first edge part and the second edge part are situated at different levels in the sheet transfer direction.

According to another aspect of the present invention, a sheet transfer apparatus includes a first transfer unit configured to transfer a sheet and provided on an upstream side of a first transfer path through which the sheet is transferred, a second transfer unit configured to transfer another sheet and provided on an upstream side of a second transfer path through which said another sheet is transferred from an opposite side of the first transfer path, a third transfer unit provided on a combined transfer path into which the first transfer path and the second transfer path merge, the third transfer unit being configured to transfer the sheet transferred from the first transfer path and said another sheet transferred from the second transfer path to a downstream side of the combined transfer path in a sheet transfer direction, and a first guiding member provided at a position where the first transfer path and the second transfer path meet. The first guiding member is configured to guide the sheet transferred from the first transfer path and said another sheet transferred from the second transfer path to the combined transfer path. At least the third transfer unit serves as a nip transfer unit formed of a pair of elements which form a nip part for nipping and transferring the sheet and said another sheet. One of the pair of elements on a side of the second transfer path is a belt transfer unit. The first guiding member has a downstream edge extending in a sheet width direction perpendicular to the sheet transfer direction. The downstream edge includes a first edge part facing the nip part and a second edge part not facing the nip part. The first guiding member has a guiding surface that faces said another sheet. A part of the guiding surface positioned at the first edge part and a part of the guiding surface positioned at the second edge part are not flush with each other.

DETAILED DESCRIPTION OF THE PREFERRED EMBODIMENTS

Figure 1:
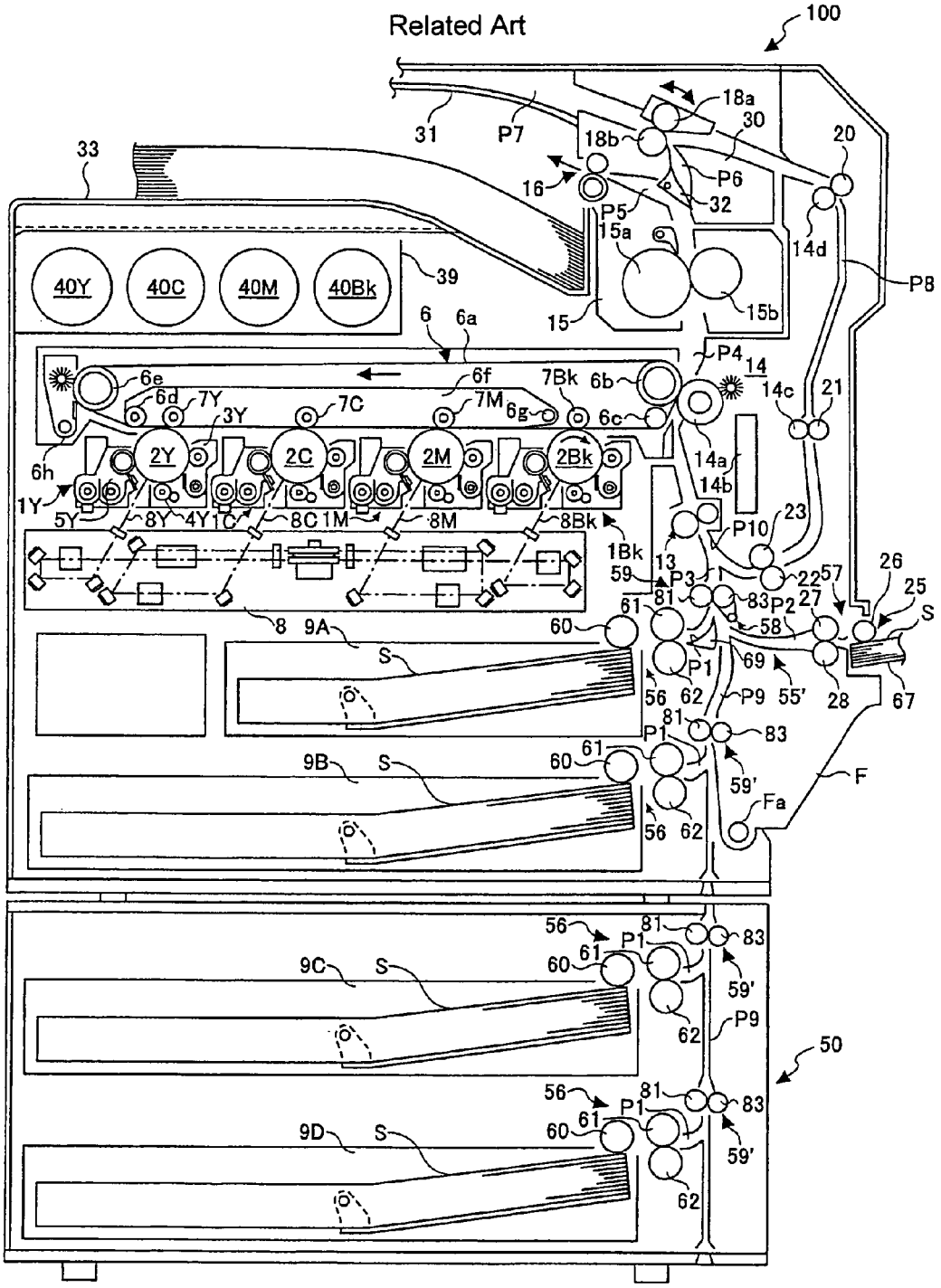
FIG.1 Related Art
FIG. 1 is a schematic cross sectional view of a substantial central part of a color printer to which the present invention is applied.

Embodiments of the present invention including the best mode are described with reference to the drawings. In examples of a paper (sheet) transfer apparatus and an image forming apparatus having the paper transfer apparatus, embodiments, deformation examples, examples, and the like, to which related Japanese applications 1 and 2 are applied, components having the same function, shape, and the like are denoted by the same reference numerals and descriptions thereof will not be repeated. To simplify the drawings and description, components which are to be included in the drawing may not be shown when no specific description is required. When components described in related Japanese applications, publications of patent applications, and the like are referenced as they are, reference numerals are used with parenthesis to distinguish the components from the components in embodiments and the like of the present invention.

An image forming apparatus to which one embodiment of the present invention is applied is an example of a full color printer employing what is called a tandem method. FIG. 1 is a central cross-sectional view of a full color printer 100.

First, with reference to FIG. 1, an internal configuration of the full color printer 100 (hereinafter also simply called "printer 100") is described. In the printer 100, as image forming units to form images of yellow (Y), cyan (C), magenta (M), and black (Bk), photoreceptors 2Y, 2M, 2C, and 2Bk in drum shapes serving as four image supports or latent image supports are provided in parallel to each other in a horizontal direction in FIG. 1 with equal intervals. When the printer 100 is operated, these photoreceptors 2Y, 2M, 2C, and 2Bk are rotated in a direction of an arrow by a driving source which is not shown.

Members and apparatuses such as a developer required for an electrophotographic type image forming apparatus are provided around the photoreceptors. These members and apparatuses are provided at four positions as image forming units. Reference numerals for imaging apparatuses are followed by alphabetical letters each expressing a color: Y (yellow), C (cyan), M (magenta), or Bk (black) to correspond to a toner color of an image to be formed. In a general description, in particular, these alphabetical letters may be omitted.

The four image forming units 1Y, 1C, 1M, and 1Bk have the same configurations other than toner colors. A charging apparatus 4, a developer 5, and a cleaner 3 are provided around the photoreceptor of each image forming unit. A belt type photoreceptor may be used as well.

In FIG. 1, the image forming unit 1Y is taken as a representative, in which the charging apparatus, the developer, and the cleaner are denoted by reference numerals 4Y, 5Y, and 3Y respectively, expressing a toner color of an image to be formed. As for other image forming units 1C, 1M, and 1Bk, reference numerals of the charging apparatus, the developer, and the cleaner are omitted to simplify the drawing.

As shown in FIG. 1, on a lower side of the photoreceptors 2Y, 2C, 2M, and 2Bk, an exposure apparatus 8 is provided to emit laser beam lights 8Y, 8C, 8M, and 8Bk corresponding to image data of each color to be scanned onto the surfaces of the photoreceptors 2 which are equally charged by the charging apparatus 4, thereby an electrostatic latent image is formed. Between the charging apparatus 4 and the developer 5, an elongated space is provided in a direction of a rotation axis of the photoreceptor 2 so that the laser light emitted by the exposure apparatus 8 reaches the photoreceptor 2.

The exposure apparatus 8 shown as an example in FIG. 1 is a laser scan type exposure apparatus using a laser light source, a polygon mirror, and the like. The exposure apparatus 8 includes four semiconductor lasers which are not shown, which emit laser beam lights 8Y, 8C, 8M, and 8Bk that are demodulated in accordance with image data to be formed. The exposure apparatus 8 stores an optical component and a control component in a housing formed of a metal or a resin. A light exit port on an upper surface has a translucent dust-proof member. In the example of FIG. 1, the exposure apparatus 8 is formed in one housing, however, plural exposure apparatuses may be separately provided in each image forming unit. Other than the exposure apparatus employing the laser, an exposure apparatus employing a combination of a known LED array and an imaging unit may also be used.

When each color toner of yellow (Y), cyan (c), magenta (M), and black (Bk) is consumed by the developer 5, the toner consumption is sensed by a toner sensor which is not shown. Then, toner is supplied from toner cartridges 40Y, 40C, 40M, and 40Bk storing each color toner, which are provided in an upper part of the printer 100, to the developer 5 by a supplying unit which is not shown. To prevent wrong insertion of the toner cartridge 40 of each color and supplying toner of wrong color to the developer, a wrong insertion preventive unit is provided in such a manner that a toner cartridge storage unit 39 and the toner cartridge 40 have predetermined shapes capable of being coupled.

Over the photoreceptors 2Y, 2C, 2M, and 2Bk, an intermediate transfer unit 6 is provided. A support roller 6*b* is rotated so that an intermediate transfer belt 6*a* serving as an image support which is supported and stretched by plural rollers 6*b*, 6*c*, 6*d*, and 6*e* rotates in a direction of an arrow. The intermediate transfer belt 6*a* is an endless belt stretched and provided so that a part of the developed photoreceptor contacts the intermediate transfer belt 6*a*. In a periphery inside the intermediate transfer belt 6*a*, primary transfer rollers 7Y, 7C, 7M, and 7Bk are provided so as to oppose each photoreceptor.

In a periphery outside the intermediate transfer belt 6*a*, a cleaner 6*h* is provided at a position opposing the roller 6*e*. The cleaner 6*h* removes a residue such as unnecessary toner and paper dust remaining on a surface of the intermediate transfer belt 6*a*. The roller 6*e* opposing the cleaner 6*h* has a unit to give a tension to the intermediate transfer belt 6*a*. The roller 6*e* moves to always keep an appropriate tension of the intermediate transfer belt 6*a*. The cleaner 6*h* opposing the roller 6*e* is also movable in conjunction with the roller 6*e*.

In the periphery outside the intermediate transfer belt 6*a* and in the vicinity of the support roller 6*b*, a secondary transfer roller 14*a* is provided. By applying a bias voltage while paper S used as an example of a sheet or a sheet type recording medium passes between the intermediate transfer belt 6*a* and the secondary transfer roller 14*a*, a toner image supported by the intermediate transfer belt 6*a* is electrostatically transferred onto the paper S.

As a sheet or a sheet type recording medium, recording paper, transfer paper, an OHP film, and the like on which a copy image can be formed can be used in addition to the paper S.

Under the exposure apparatus 8, there are provided plural stages of, for example, two stages of paper feed cassettes 9A and 9B which can be drawn out. The paper S stored on a paper feed tray (bottom plate) in the paper feed cassette 9A is picked up by the rotation of a pick-up roller 60. The paper S picked up by the pick-up roller 60 is then sent through a first transfer path P1 as a first transfer channel by a feed roller 61 and a reverse roller 62 which serve as a separation paper feed unit which separates the paper S one by one, and a grip roller 81 and a belt transfer unit 58 which serve as a third transfer unit (nip transfer unit), and then sent to a combined transfer path P3 as a combined transfer channel.

The paper S stored on the paper feed tray (bottom plate) in the paper feed cassette 9B is picked up by the rotation of the pick-up roller 60. The paper S picked up by the pick-up roller 60 is sent through the first transfer path P1 by the feed roller 61 and the reverse roller 62 which serve as a separation paper feed unit to separate the paper S one by one and the grip roller 81 and a transfer roller 83 which serve as the third transfer unit (nip transfer unit), and then sent to a vertical transfer path P9 as a combined transfer path.

In each of the paper feed cassettes 9A and 9B, the pick-up roller 60, the feed roller 61, and the reverse roller 62 are provided on an upstream side of the first transfer path P1 and form a first transfer unit to transfer paper P. In the paper feed cassette 9B, a third transfer unit (nip transfer unit) 59' has a similar configuration to a conventional sheet transfer apparatus, which is formed of the grip roller 81 and the transfer roller 83. This configuration is similar in the third transfer units (nip transfer unit) 59' of the paper feed cassettes 9C and 9D in the paper feed apparatus 50, which is described below.

On the downstream side of the combined transfer path P3, a pair of resist rollers 13 for timing the transfer of the paper S to a secondary transfer unit is provided. The paper S is transferred from the pair of resist rollers 13 to the secondary transfer unit formed of the intermediate transfer belt 6*a* and the secondary transfer roller 14*a*.

A manual paper feed apparatus 25 provided on a right side of FIG. 1 can be rotated, that is pivoted at a predetermined angle to be stored in a frame F which is a part of a body of the printer 100. The top paper S stored in a paper feed tray in the manual paper feed apparatus 25 is picked up by a rotation of a pick-up roller 26. The paper S picked up by the pick-up roller 26 is transferred through a second transfer path P2 serving as a second transfer channel and the combined transfer path P3 by a feed roller 27 and a reverse roller 28 which serve as a separation paper feed unit configured to separate the paper S one by one, and a grip roller 81 and a belt transfer unit 58 which serve as a third transfer unit (nip transfer unit).

A fixation apparatus 15 having a heating unit is provided above the secondary transfer unit. In this example, the fixation apparatus 15 is formed of a heating roller 15*a* incorporating a heater and a pressure roller 15*b*. However, the fixation apparatus 15 may include a belt or an IH unit as the heating unit as required.

A switching guide member 32 is rotatable, in other words, is pivotable about an axis in a range of a predetermined angle. In FIG. 1, the switching guide member 32 guides the paper which underwent fixation to a paper output path P5. The paper is then outputted by a pair of paper output rollers 16 and stacked in a paper output stack unit 33 serving as a paper output tray in an upper part of the printer 100.

The printer 100 shown in FIG. 1 includes transfer paths and rollers configured to invert and feed the paper again, so that images can be automatically formed on both sides of the paper. Specifically, a switching-back path P7 is provided over the paper output unit (unit having the paper output rollers 16 and the like). The paper P sent from one of the paper feed units (paper feed cassettes 9A to 9D) undergoes an image transfer on one side through the second transfer unit and the fixation apparatus 15. Then, the switching guide member 32 is pivoted clockwise so that the paper is transferred to transfer rollers 18*a* and 18*b* which can rotate inversely, that are capable of forward and reverse rotation through the transfer path P6 partly formed of a left side surface of a paper guiding member 30. The paper S is guided by the transfer roller 18*a* to the switching-back path P7 which is formed of an inner tray 31.

After a rear edge of the paper P is separated from a leading edge of the paper guiding member 30 on the downstream side, the transfer roller 18*a* rotates counterclockwise so as to guide the paper P to a paper refeed path P8. The paper P is transferred through a pair of transfer rollers 20 and 14*d* and a pair of transfer rollers 21 and 14*c* which are provided in the paper refeed path P8. The paper P is then nipped by rollers 22 and 23 which contact each other and are capable of inversely rotating, and transferred through the combined transfer path P3 to be fed to the resist roller 13 again.

As described above, the roller 23 contacts the roller 22 which is capable of inversely rotating. The roller 22 rotates clockwise to transfer paper with the roller 23 from the manual paper feed apparatus 25. The roller 22 rotates counterclockwise to transfer the paper S transferred through the paper refeed path P8 with the roller 23 to be fed again to the resist roller 13.

The printer 100 shown in FIG. 1 includes another paper feed apparatus 50 in a lower part. In this example, two paper feed cassettes 9C and 9D are provided in the paper feed apparatus 50. However, more paper feed cassettes may be provided or a paper feed cassette capable of storing more sheets of paper may be mounted as well.

In FIG. 1, reference numeral 55' denotes an example of a paper transfer apparatus serving as a sheet transfer apparatus included in the printer 100. The paper transfer apparatus 55' is substantially similar to a paper transfer apparatus (5C) described in paragraphs [0156] to [0177] in a third embodiment and shown in FIGS. 24 to 32 of related Japanese application 2 and has a novel configuration, therefore, the paper transfer apparatus 55' is described in detail below. The paper transfer apparatus 55' is different from the paper transfer apparatus (5C) mainly in that an FRR method is employed for a separation unit.

Operations to form and record an image on a single side of the paper S are described based on the aforementioned configuration. First, a surface of the photoreceptor 2Y equally charged by the charging apparatus 4Y is irradiated with the laser beam light 8Y corresponding to image data for yellow, which is emitted from the semiconductor laser (not shown) operated by the exposure apparatus 8. In this manner, an electrostatic latent image is formed on one side of the paper S.

The electrostatic latent image undergoes a development process by the developer 5Y to be developed by a yellow toner, thereby the electrostatic latent image becomes a visible image. The image then undergoes a primary transfer by a transfer operation of a primary transfer roller 7Y onto a surface of the intermediate transfer belt 6*a* which rotates in synchronization with the photoreceptor 2Y. These steps of forming, developing, and carrying out the primary transfer of the latent image are similarly performed sequentially at the photoreceptors 2C, 2M, and 2Bk at appropriate timing.

As a result, toner images of yellow Y, cyan C, magenta M, and black Bk are sequentially overlapped and formed as a four-color toner image to be supported on the intermediate transfer belt 6*a*. The four-color toner image is then transferred in a direction of an arrow by the intermediate transfer belt 6*a*. The surface of the photoreceptor 2 is, on the other hand, cleaned by the cleaner 3 to be removed of remaining toner or a foreign object.

The four-color toner image formed on the intermediate transfer belt 6*a* is transferred by a transfer operation of the secondary transfer roller 14*a* onto the paper S which is transferred in synchronization with the intermediate transfer belt 6*a*. A surface of the intermediate transfer belt 6*a* is cleaned by the belt cleaner 6*h* to be prepared for next imaging and transfer steps. The paper S on which the image is transferred then undergoes a fixation operation by the fixation apparatus 15 and is outputted by the paper output rollers 16 into the paper output stack unit 33 with the surface on which the image is transferred facing down (face down).

In such a configuration, operations to form and record images on both sides of the paper S are described. As described above, an image is transferred from the intermediate transfer belt 6*a* onto one side of the paper S first. Then, the paper S which has passed through the fixation apparatus 15 is guided by the switching guide member 32 to the pair of transfer rollers 18*a* and 18*b*. The paper S is then transferred to the switching-back path P7 which is formed of the inner tray 31 by the transfer rollers 18*a* and 18*b*. The transfer roller 18*a* capable of inversely rotating rotates counterclockwise when a rear edge of the paper S is separated from the leading edge of the paper guiding member 30. By using the rear edge of the paper S as a leading edge this time, the paper S is transferred through the pairs of rollers 14*d* and 20, and 14*c* and 21 to the pair of rollers 22 and 23. After that, the paper S reaches the pair of resist rollers 13. The paper S having the image on one side is transferred to the secondary transfer unit having the secondary transfer roller 14*a* again at the timing of the pair of resist rollers 13. In this manner, a toner image on the intermediate transfer belt 6*a* is transferred on the other surface of the paper S.

The image to be formed on the other surface of the paper S is formed by sequential imaging steps which start when the paper S is transferred to a predetermined position. The imaging steps in this case are also similar to the steps of forming a full color toner image on one surface of the paper. The full color toner image formed in this manner is supported on the intermediate transfer belt 6*a*. Since the leading edge and the rear edge of the paper S are inverted in the paper refeed path P8, image data emitted from the exposure apparatus 8 are controlled when formed so that the image is formed inversely of the paper transfer direction with respect to the first imaging.

The paper S having full color toner images transferred on both surfaces undergoes a fixation process by the fixation apparatus 15 again, and is outputted by the paper output rollers 16 onto the paper output stack unit 33. To raise an efficiency of forming images on both sides of the paper, plural sheets of paper can be transferred in each transfer path at the same time. Further, images are formed on the front and back surfaces of the paper at a timing controlled by a controller (not shown).

Heretofore, the description has been made on examples to perform full color printing by way of single-sided printing and double-sided printing operations. When performing monochrome printing using only a black color, some of the photoreceptors are not used. The photoreceptors 2Y, 2C, and 2M or the developers 5Y, 5C, and 5M are not operated. In addition, there is provided a mechanism to keep these photoreceptors and the intermediate transfer belt 6*a* away from each other. In this example, an internal frame 6*f* configured to support the roller 6*d* and the primary transfer rollers 7Y, 7C, and 7M to be capable of rotating, that is, pivoting at a predetermined angle about an axle 6*g*, is supported. By pivoting the internal frame 6*f* in a direction of separating away from the photoreceptors (clockwise in FIG. 1), only the photoreceptor 2Bk contacts the intermediate transfer belt 6*a*, and faces and contacts the primary transfer roller 7Bk with the intermediate transfer belt 6*a* interposed therebetween. In this manner, a monochrome image is formed by a black toner. As a result, the life of the photoreceptor is improved.

Further, the frame F has a configuration (not shown) which is pivotably opened about a rotation axle Fa in a lower part when a paper jam is generated in one of the transfer paths. By operating a lock lever (not shown) to open the frame F, almost all the transfer paths can be opened. Therefore, jammed paper can be easily removed.

The secondary transfer unit 14 having the transfer path P4 and the paper refeed path P8 on both sides is pivoted about an axis of the roller 23. The secondary transfer unit 14 is pivotable so that the secondary transfer roller 14*a* is separated from the intermediate transfer belt 6*a*, and the rollers 14*c* and 14*d* are separated away from the rollers 21 and 20 respectively when the frame F is opened. The secondary transfer unit 14 incorporates a power source 14*b*, and is capable of transferring the paper S outside a casing as described above.

(Reference Example)

With reference to FIGS. 2 to 9, a paper transfer apparatus 55 according to a reference example (corresponding to related Japanese application 2) of the present invention is described. First, a basic layout of the example is described with reference to FIG. 8, comparing with the conventional example.

Figure 8A:
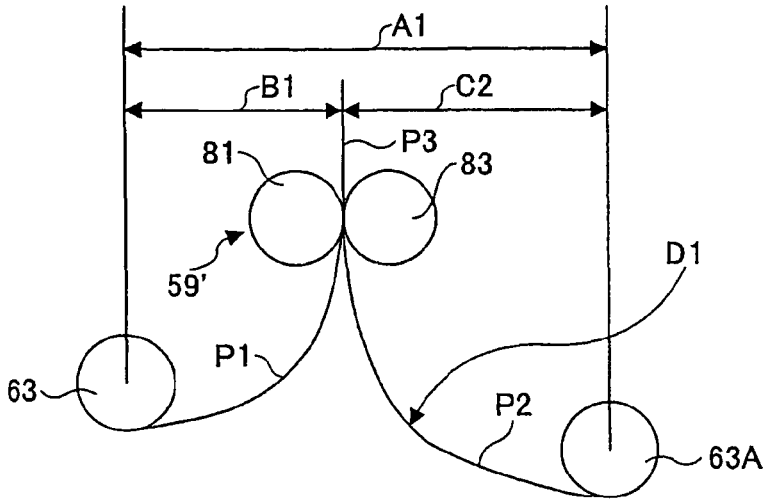
FIGS. 8A and 8B are conceptual and schematic views of basic layouts, of a conventional paper transfer apparatus and of a paper transfer apparatus of a reference example, respectively.
Figure 8B:
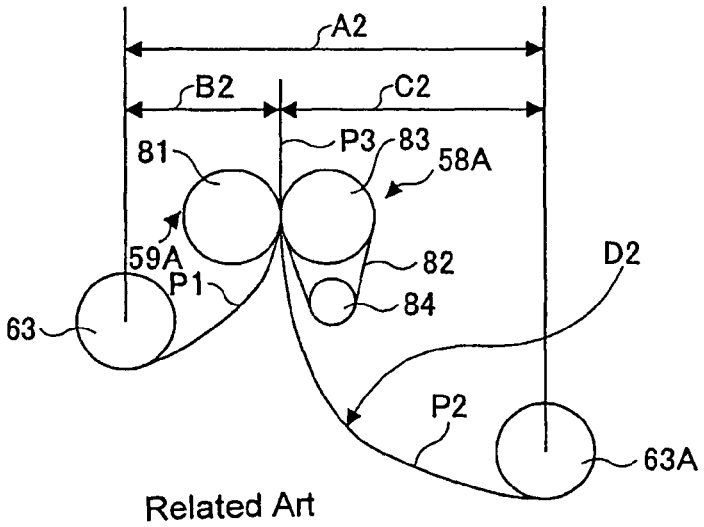
Related Art FIG.8B

FIGS. 8A and 8B are conceptual and schematic diagrams each showing a first transfer path P1 (hereinafter also called a "left transfer path" in FIG. 8) serving as a first transfer channel through which paper (sheet) is transferred, and a second transfer path P2 (hereinafter, also called a "manual transfer path", which is hereinafter omitted, and also called a "right transfer path" in FIG. 8) serving as a second transfer channel through which paper (sheet) is transferred from an opposite side of the first transfer path P1. The first transfer path P1 and the second transfer path P2 are arranged in a horizontal direction corresponding to a width direction (horizontal direction in FIGS. 1 and 2) of an apparatus body. The left and right transfer paths merge right before third transfer unit (nip transfer unit) 59A and 59', thereby the combined transfer path P3 serving as a combined transfer channel is formed.

FIG. 8A shows a conventional example in which the third transfer unit (nip transfer unit) 59' is formed of the grip roller 81 and a pulley 83 in a transfer roller shape (also called "follower roller 83" in FIG. 8) which faces and contacts the grip roller 81. FIG. 8B shows the reference example in which the third transfer path 59 is formed of the grip roller 81 and the belt transfer unit 58A.

In the configuration of the conventional example shown in FIG. 8A, there is a horizontal distance or interval of B1 between a center of an axis center of a feed roller 63 in the left transfer path and a center of a nip between the grip roller 81 and the follower roller 83. There is a horizontal distance or interval of C2 between a center of an axis center of a feed roller 63A in the right transfer path and the center of the nip between the grip roller 81 and the follower roller 83. There is a horizontal distance or interval of A1 between the axis centers of the feed rollers 63 and 63A in the left and right transfer paths. Further, a curvature radius of the second transfer path P2 on the right side is D1. In the conventional example, for example, the right transfer path (manual transfer path P2) can transfer paper S with more paper weight per square meter than the left transfer path (first transfer path P1). As a result, the right transfer path has a larger curvature radius than the left transfer path.

In the configuration of the reference example shown in FIG. 8B, on the other hand, the belt transfer unit 58A is provided in a position corresponding to an outer surface of the left transfer path (first transfer path P1) as disclosed in the second embodiment of related Japanese application 2. In other words, the belt transfer unit 58A is provided as an outer surface of the combined transfer path P3 when seen from the left transfer path of the combined transfer path P3 (combined transfer channel) and an inner surface of the combined transfer path P3 when seen from the right transfer path in the combined transfer path P3. As a result, various types of paper can be transferred even with the left transfer path having a small curvature radius. Consequently, the horizontal distance or interval of B2 between the axis center of the feed roller 63 and the center of the nip between the grip roller 81 and the follower roller 83 can be set shorter compared to the distance or interval B1 of the conventional example shown in FIG. 8A.

Since B2 is set shorter than B1, the horizontal distance or interval A2 between the axis centers of the feed rollers 63 and 63A can be set shorter compared to the distance or interval A1 in the conventional example shown in FIG. 8A. Moreover, by setting A2 to be the same as A1, the curvature radius D2 of the right transfer path can be set larger than the curvature radius D1 of the conventional example shown in FIG. 8A. Thus, paper can be more stably transferred.

By providing the belt transfer unit 58A at a position corresponding to the inner surface of the right transfer path (manual transfer path P2) as disclosed in the first embodiment of related Japanese application 2, various types of paper can be transferred even when the curvature radius D2 of the right transfer path is set smaller than that of the conventional example shown in FIG. 8A.

Therefore, the curvature radius D2 of the right transfer path can be set smaller than D1 of the conventional example shown in FIG. 8A. As a result, the horizontal distance or interval C2 between the center of the nip between the grip roller 81 and the follower roller 83 and the axis center of the feed roller 63A can be set shorter than C2 in the conventional example shown in FIG. 8A.

As described above, the belt transfer unit 58A is provided in a third transfer unit 59 serving as the combined transfer path P3 of the left and right transfer paths. In this manner, various types of paper can be transferred from the left and right transfer paths while downsizing the apparatus compared to the conventional apparatus. Alternatively, the curvature radius of one of the left and right transfer paths can be set large without changing the conventional apparatus width. As a result, various types of paper can be stably transferred.

Next, an example of applying the concept of the configuration shown in FIG. 8B to a sheet transfer apparatus and an image forming apparatus is described with reference to FIGS. 2 through 7 and 9.

Figure 2:
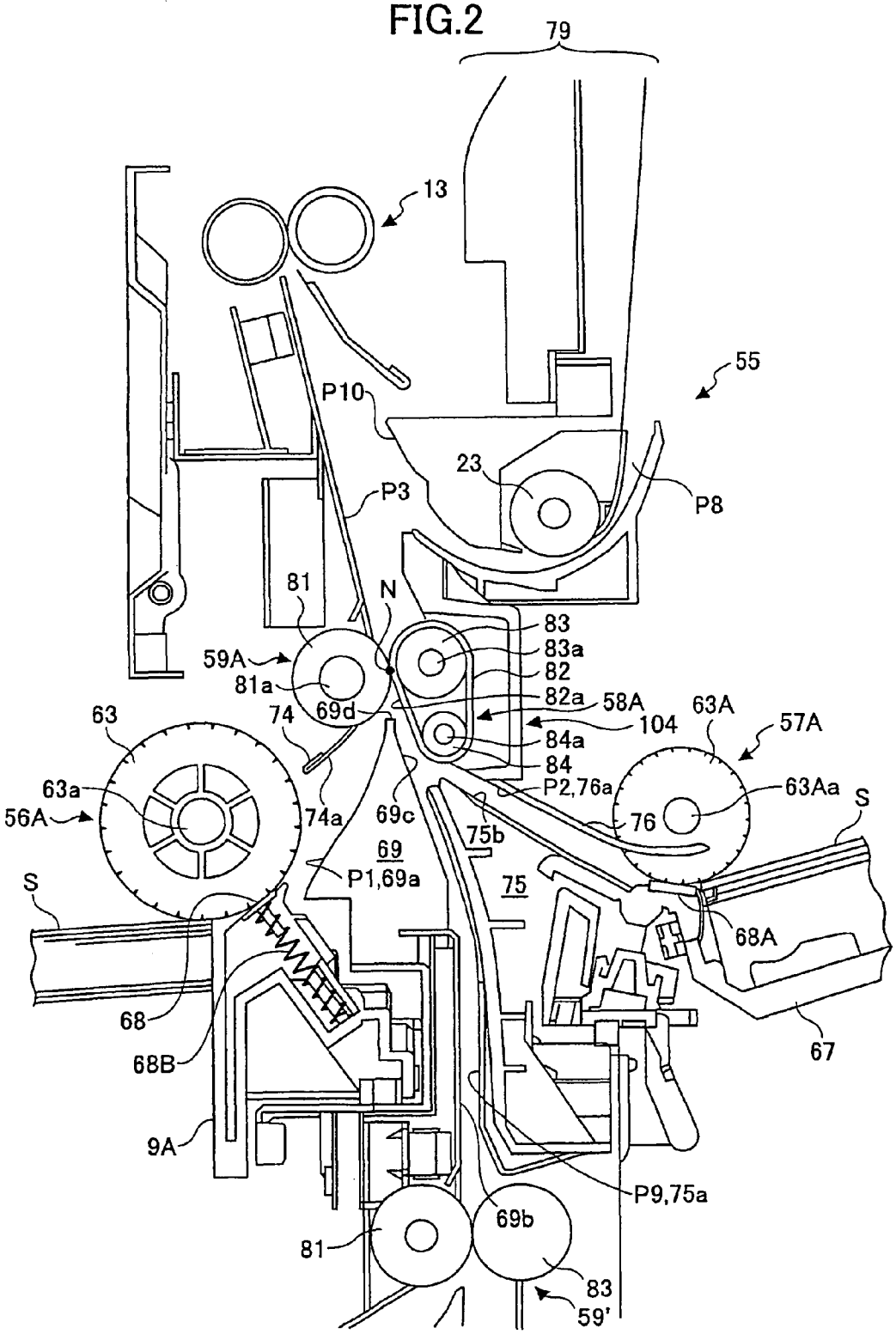
FIG. 2 is a cross sectional view showing a major part of a substantial central part in a paper transfer apparatus of a reference example to which the present invention is applied.

The paper transfer apparatus 55 of this reference example is different from the paper transfer apparatus 55' provided in the printer 100 shown in FIG. 1 mainly in that a first transfer unit 56A, a second transfer unit (manual paper feed unit) 57A, and a third transfer unit 59A are provided as shown in FIG. 2, instead of the first transfer unit 56 which is provided on the upstream side of the first transfer path P1 through which the paper S on the paper feed cassette 9A is transferred and which transfers the paper S on the paper feed cassette 9A; the second transfer unit (manual paper feed unit) 57 which is provided on the upstream side of the second transfer path through which the paper S on the manual paper feed tray 67 is transferred from the opposite side of the first transfer path P1; and the third transfer unit 59 which is provided in the combined transfer path P3 and which transfers the paper S transferred from the first and second transfer paths P1 and P2 to the downstream side of the combined transfer path P3. Other than these differences, this reference example is similar to the printer 100 shown in FIG. 1.

More specifically, the paper feed separation method is changed. This reference example employs a friction pad method (the first transfer unit 56A) as shown in FIGS. 2 to 6, as compared to the example shown in FIG. 1 which employs the FRR method. As a result, spaces of the left and right sides in the apparatus are reduced, and the paper feed separation method of a manual tray 67 is changed to the friction pad method (second transfer unit (manual paper feed unit) 57A). Consequently, there are the following changes. The manual tray 67 is moved to the left side in the drawing; the belt transfer unit 58A is used as the third transfer unit 59A instead of using the belt transfer unit 58 provided in the third transfer unit 59; a position (in particular, a transfer surface 82*a* of the transfer belt 82) and a direction to transfer the paper S of the belt transfer unit 58A are set inclined in a left oblique direction and the belt transfer unit 58A is provided close to the first transfer unit 56A; a combined transfer path 10 serving as a combined transfer channel to which the paper refeed path P8 is combined is moved to the left in the drawing since the combined transfer path P3 extending from the third transfer unit 59A having the belt transfer unit 58A to the pair of resist rollers 13 is moved to the left in the drawing; and the belt transfer surface 82*a* of the belt transfer unit 58A is provided as the inner surface of, that is, on a side of the manual transfer path P2 configured to guide the paper S transferred from the manual paper tray 67. Other than these differences, the paper transfer apparatus 55 of this reference example shown in FIG. 2 is similar to the paper transfer apparatus 55' shown in FIG. 1.

The first transfer unit 56A is different from the first transfer unit 56 shown in FIG. 1 in that the feed roller 63 serving as a rotation paper feed member and a first counter transfer member supported rotatably about an axle 63*a* in a direction of sending out the paper; a friction pad 68 serving as a friction member pressed onto the feed roller 63, a spring 68B (compression spring) serving as a biasing member configured to bias the friction pad 68 to be pressed onto the feed roller 63; and the like are provided as a separation paper feed unit as shown in FIG. 2 and the like instead of the feed roller 61 and the reverse roller 62. The feed roller 63 is rotated by a driving mechanism (22A), which is described below, configured to rotate the grip roller 81.

The friction pad type separation paper feed unit has a function to separate and feed the top paper S stacked on the paper feed tray in the paper feed cassette 9A by co-operation of the feed roller 63 and the friction pad 68. That is, the friction pad 68 is pressed onto the feed roller 63 at an appropriate separation angle by a separation pressure of the spring 68B through a slider. As a result, the paper S passes through a nip formed in this manner between the feed roller 63 and the friction pad 68. By the separation paper feed unit employing the friction pad method, even when two overlapped sheets of the paper S are drawn out, the paper S on the lower side receives higher resistance from the friction pad 68 than the resistance caused by the friction between the overlapped sheets. Thus, the paper S on the lower side is prevented from moving in the transfer direction any more. On the other hand, the paper S on the upper side receives transfer force of the feed roller 63, which is higher than the resistance between the overlapped sheets and the resistance of the friction pad 68. Therefore, only the paper S on the upper side proceeds in the transfer direction.

In the second transfer unit (manual paper feed unit) 57A, a feed roller 63A serving as a rotation paper feed member capable of rotating about an axle 63Aa in a direction of sending out the paper; a friction pad 68A serving as a friction member configured to be pressed onto the feed roller 63A; a spring (compression spring), which is not shown, serving as a biasing member configured to bias the friction pad 68A onto the feed roller 63A; and the like are provided as a separation paper feed unit, instead of the paper feed roller 67A and the separation rollers 67B and 67C which are used in the FRR method shown in FIG. 1. The feed roller 63A is rotated by a driving motor or the like serving as a driver which is not shown.

The manual paper feed tray 67, the feed roller 63A, the friction pad 68A, and the like form a manual paper feed unit.

As shown in FIG. 2, the paper feed apparatus 55 includes a first transfer path P1 through which the paper S is transferred, a manual transfer path P2 through which the paper S is transferred from an opposite side to the first transfer path P1, a combined transfer path P3 into which the first transfer path P1 and the second transfer path P2 merge, and the belt transfer unit 58A provided as an outer surface of the combined transfer path P3 when seen from the first transfer path P1 of the combined transfer path P3 and an inner surface of the combined transfer path P3 when seen from the manual transfer path P2 in the combined transfer path P3, that is on the manual transfer path P2 side. Hereinafter, transfer guiding members 69, 74, 75, 76, the belt transfer unit 58A, and a configuration which is omitted in the description of FIG. 1 are described in detail.

In FIG. 2, the transfer guiding member 69 is provided at a position right before the combined transfer path P3, where the first transfer path P and the second transfer path P2 serving as the manual transfer path merge. The transfer guiding member 69 functions as a first guiding member configured to guide the paper S transferred from the first transfer path P1 and the second transfer path P2 to a nip part (nip point) of the third transfer unit 59A and to the downstream side of the combined transfer path P3.

The transfer guiding member 69 includes a guiding surface 69*a* serving as the first transfer path P1, a guiding surface 69*b* (actually formed of another guiding member) serving as the vertical transfer path P9, and a guiding surface 69*c* which serves as a part of a combined transfer path into which the vertical transfer path P9 and the second transfer path P2 merge, and which is formed substantially parallel to the belt transfer surface 82*a* with a predetermined space. A downstream edge 69*d* (an upper edge in FIG. 2) of the transfer guiding member 69 extends toward the grip roller 81 and is provided close to the grip roller 81.

The transfer guiding member 74 has a guiding surface 74*a* facing the guiding surface 69*a* of the transfer guiding member 69 with a predetermined space. The guiding surface 74*a* is a curved surface bulging in a substantially downward direction (toward the transfer guiding member 69 provided as the outer surface of the first transfer path when seen from the guiding surface 74*a*, that is on the second transfer path side). The guiding surface 74*a* is curved so that the paper S is curved and a leading edge of the paper S necessarily reaches the transfer surface 82*a* of the transfer belt 82.

The transfer guiding member 74 extends from the downstream side of the combined transfer path P3 to the upstream side so as to face a nip part N of the third transfer unit 59A. The transfer guiding member 74 functions as a fourth guiding member configured to guide the paper S transferred through the combined transfer path P3 to the downstream side of the combined transfer path P3.

The transfer guiding member 75 serves as a second guiding member configured to guide the paper S transferred through the second transfer path P2. The transfer guiding member 75 serves as one side of the second transfer path P2 and faces the belt transfer unit 58A. The transfer guiding member 75 has a guiding surface 75*a* serving as a part of the vertical transfer path (alternatively, a common transfer path or a combined transfer path) P9 for transferring the paper S transferred from the paper feed cassettes 9B, 9C, and 9D to the combined transfer path P3 through the belt transfer surface 82*a*. The transfer guiding member 75 further includes a guiding surface 75*b* serving as a part of the second transfer path P2 and facing the guiding surface 76*a* of the transfer guiding member 76 to be substantially in parallel to the guiding surface 76*a*.

The transfer guiding member 76 has a curved part at its end so as to guide the paper S transferred through the second transfer path P2 to the combined transfer path P3. The transfer guiding member 76 serves as a third guiding member provided to form the other side of the second transfer path P2 and faces the transfer guiding member 75.

Inside the curved second transfer path P2 which runs through the feed roller 63A of the second transfer unit (manual paper feed unit) 57A, the pulley 84 of the belt transfer unit 58A, and the pulley 83 on an upper side, the transfer guiding member 76 formed of the guiding surface 76*a* and transfer guide ribs 76*b* for reinforcement are provided. The transfer guiding member 76 has a shape shown in FIG. 3.

The transfer guiding members 69, 75, and 76 are formed of an appropriate resin in an integrated manner. The transfer guiding member 74 is formed of a steel plate, which is a thin metal plate.

The belt transfer unit 58A is different from the belt transfer unit (8) shown in FIGS. 1 to 4 and 7 of related Japanese application 2 in the following points. As shown in FIGS. 3 to 6, three belt transfer units 58A are mounted with a pulley axle 83*a* and a pulley axle 84*a* in a housing case 105 in advance. A belt transfer unit 104 is provided detachably with respect to an open-close guide 79 (or an apparatus body (78) having a housing (80), on the paper transfer apparatus 55 side) shown in FIG. 2. Further, the transfer guiding member 76 is used instead of a transfer guiding member (72). Other than these differences, the belt transfer unit 58A shown in FIGS. 3 to 6 is similar to the belt transfer unit (8) shown in FIGS. 1 to 4 and 7 and described in Example 1 of related Japanese application 2.

Outermost edges of the pulley 83 and the transfer belt 82 provided on outermost sides in a paper width direction Y are designed and mounted to be smaller than the minimum size (paper size in the paper width direction Y) of the paper S used in the printer 100 having the paper transfer apparatus 55 shown in FIG. 2. Similarly, outermost edges of the grip rollers 81 provided on the outermost sides in the paper width direction Y are designed and mounted to be smaller than the minimum size of the paper S used in the printer 100 having the paper transfer apparatus 55.

That is, a nip transfer unit 59A (formed of the grip roller 81 and the belt transfer unit 58A) provided in the paper (sheet) width direction Y vertically crossing the paper (sheet) transfer direction has a continuous configuration extending in the paper width direction Y so as to contact a part of the paper S in the paper width direction Y, that is more specifically a central part of the paper S.

Similarly to the first embodiment shown in FIGS. 13 to 21 and described in paragraphs [0126] to of related Japanese application 2, the grip roller 81 serving as the other of a pair forming the nip transfer unit 59A is a rotation transfer driving unit which can transmit a driving force by rotation. One of the pair forming the nip transfer unit 59A operates following the rotation transfer driving unit. The belt transfer unit 58A has the transfer belt 82 which adds a transfer force by contacting the surface of the paper transferred from the second transfer path (manual transfer path) P2 toward a nip point (nip part) between the grip roller 81 and the transfer belt 82 of the belt transfer unit 58A.

Figure 14:
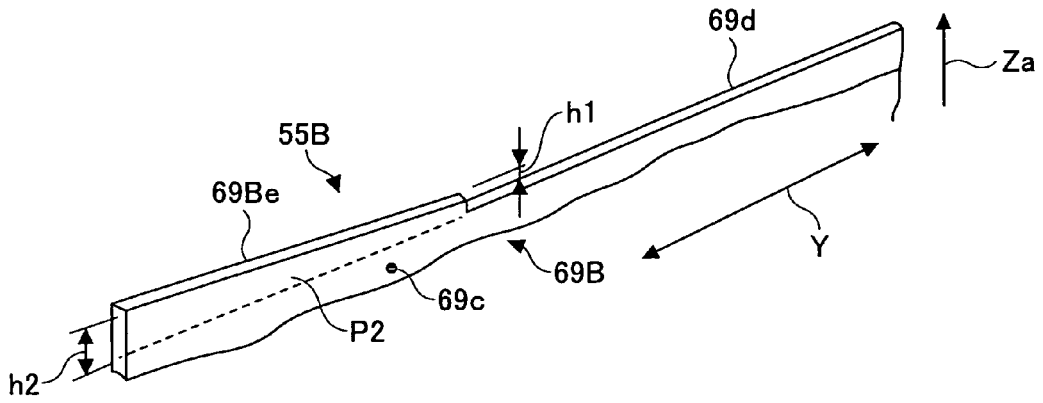
FIG. 14 is a perspective view showing a major part of a transfer guiding member in a paper transfer apparatus of a deformation example 1.

The grip roller 81 serves as a rotation transfer driving unit driven by a driving mechanism which is similar to the driving mechanism (22A) shown in FIG. 14 of related Japanese application 2.

The pulleys 83 and 84 of the belt transfer unit 58A are formed to be lightweight using a resin such as a polyacetal resin having favorable lubricity, abrasion resistance, and durability. The pulleys 83 and 84 are formed to have fit and size relationships capable of allowing the pulley axles 83*a* and 84*a* to pass through respectively. The pulleys 83 and 84 are pivotably mounted and supported to the pulley axles 83*a* and 84*a* respectively. Each of the pulley axles 83*a* and 84*a* is one through-axle which passes through through-holes (not shown) of the upper three pulleys 83 and the lower three pulleys 84 respectively.

The housing case 105 is, for example, also formed to be lightweight using a resin such as a polyacetal resin having favorable lubricity, abrasion resistance, and durability. The housing case 105 includes holders 105*a* which also serve as bearings; belt supports 105*b* which section and support the pulleys 83 and the transfer belts 82; a body 105*c* which serves as a unit to unite, mount, and operate the holders 105*a* and the belt supports 105*b;* projections 105*d* used as references for the mounting in the paper width direction Y; and a pair of left and right spring stages 105*e* to mount and lock one end of each spring 106 (compression spring) serving as a biasing unit, a biasing member, or an elastic member shown in FIG. 6, which are integrally formed. The belt supports 105*b* in the housing 105 have through-holes 105*f* for allowing the pulley axle 84*a* to pass through.

Figure 6:
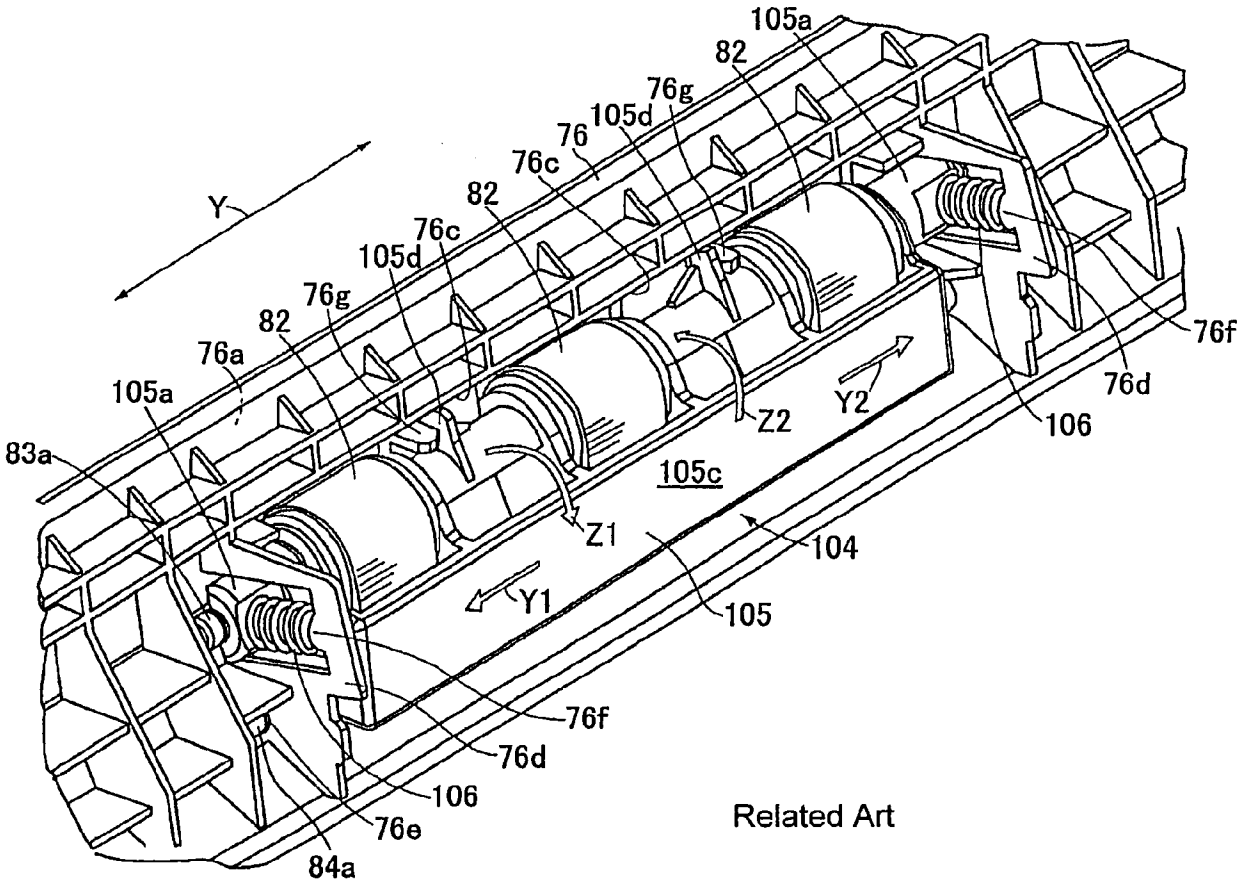
FIG. 6 is a perspective view of a major part of a state that a belt unit of the paper transfer apparatus of FIG. 2 is attached and assembled in a transfer guiding member, seen from a backside of the transfer guiding member.

As shown in FIG. 6, the transfer guiding member 76 includes a guiding surface 76*a;* spring locking units 76*f* which are formed on a back surface of the guiding surface 76*a* for reinforcement and configured to mount and lock the other end of the springs 106; a pair of left and right ribs 76*d* each having a groove for mounting elements such as the springs 106; and a pair of left and right regulators 76*g* used in combination with the projections 105*d* as a reference for the assembly in the paper width direction Y when mounting the belt transfer unit 104. These elements are formed of an appropriate resin in an integrated manner. Further, the transfer guiding member 76 includes apertures 76*c* for allowing the belt transfer surfaces 82*a* of the belt transfer unit 104 to face the first transfer path P1, the vertical transfer path P9, and the second transfer path P2 sides from the guiding surface 76*a* when mounting the belt transfer unit 104. Further, the transfer guiding member 76 includes a through-hole 76*e* in the rib 76*d* to allow the pulley axle 84*a* to pass through when mounting the belt transfer unit 104. The apertures 76*c* and the through-hole 76*e* are formed in an integrated manner.

Next, a process to mount the belt transfer unit 104 in the open-close guide 79 shown in FIG. 2 is briefly described.

Figure 4:
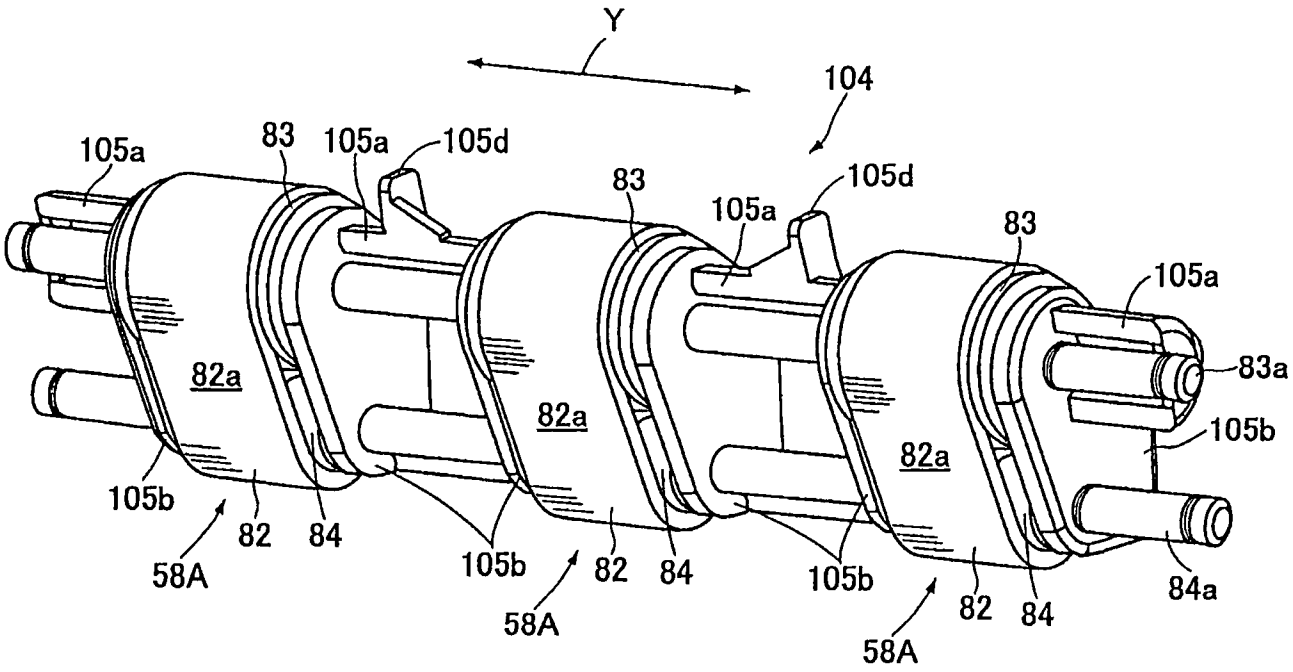
FIG. 4 is a perspective view of a major part of a belt unit and its periphery in the paper transfer apparatus of FIG. 2, seen from the grip roller side.
Figure 5:
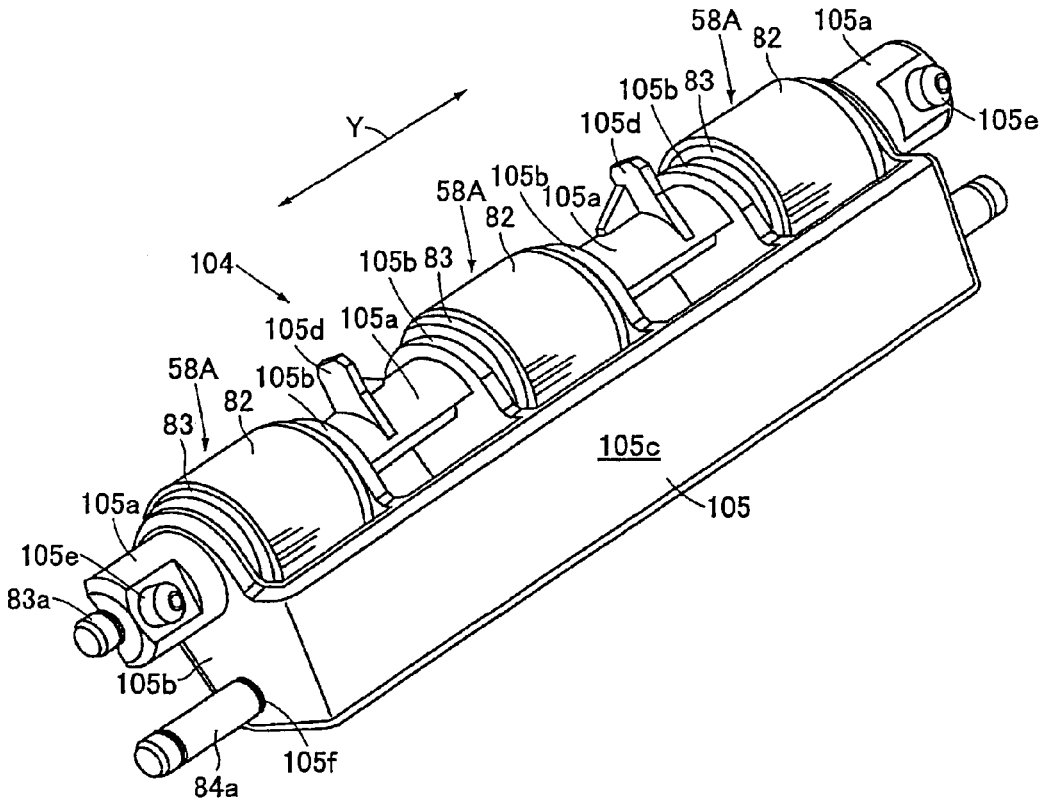
FIG. 5 is a perspective view of a major part of a belt unit and its periphery in the paper transfer apparatus of FIG. 2, seen from a backside of a transfer guiding member.

First, the transfer belts 82 are looped around the upper and lower pulleys 83 and 84. Next, the pulley axle 83*a* passes through the pulleys 83. At the same time, the pulley axle 84*a* passes through the through-holes formed at both ends of the belt supports 105*b* of the housing case 105 and the pulleys 84. As a result, predetermined tension is applied to the transfer belts 82 looped around the pulleys 83 and 84 having the axles provided with a predetermined interval. At the same time, the pulleys 83 and 84, the transfer belts 82, and the pulley axles 83*a* and 84*a* are temporarily mounted in the housing case 105. In this manner, the belt transfer unit 104 shown in FIGS. 4 and 5 is formed. In this case, stopper rings (not shown) are mounted to the pulley axle 83*a* which extends outside from left and right sides of the holders 105*a*, so that the displacement of the pulley axle 83*a* in the paper width direction Y is restricted at the holders 105*a* of the housing case 105.

Next, when mounting the belt transfer unit 104 in the transfer guiding member 76 of the open-close guide 79, a left end portion of the pulley axle 84*a*, which extends to the left side from the belt support 105*b* on the left side of the drawing, is inserted from right to left in a direction of an arrow Y1 into the through-hole 76*e* formed in the rib 76*d* on the left side in the transfer guiding member 76. At this time, the projections 105*d* are rotated in a direction of an arrow Z1 to be displaced from the position shown in FIG. 6 and tilted, so that the projections 105*d* of the belt transfer unit 104 do not interfere with the regulators 76*g* of the transfer guiding member 76.

With the projections 105*d* of the belt transfer unit 104 tilted as described above, a right end portion of the pulley axle 84*a*, which extends to the right side from the belt support 105*b* on the right side, is inserted from left to right in a direction of an arrow Y2 into the through-hole 76*e* formed in the rib 76*d* on the right side of the transfer guiding member 76. Next, the position of the projections 105*d* of the belt transfer unit 104 is rotated in a direction of an arrow Z2 to be displaced. As a result, the left and right projections 105*d* are engaged with the left and right regulators 76*g* respectively, thereby the displacement of the belt transfer unit 104 in the paper width direction Y is regulated. Subsequently, the springs 106 are mounted between the spring stages 105*e* and the spring locking units 76*f* on the left and right sides respectively. Then, stopper rings (not shown) are mounted to both ends of the pulley axle 84*a* extending outside from the left and right ribs 76*d* of the transfer guiding member 76. As a result, the displacement of the pulley axle 84*a* in the paper width direction Y is regulated in the transfer guiding member 76 and mounted and supported by the left and right ribs 76*d* of the transfer guiding member 76.

Figure 3:
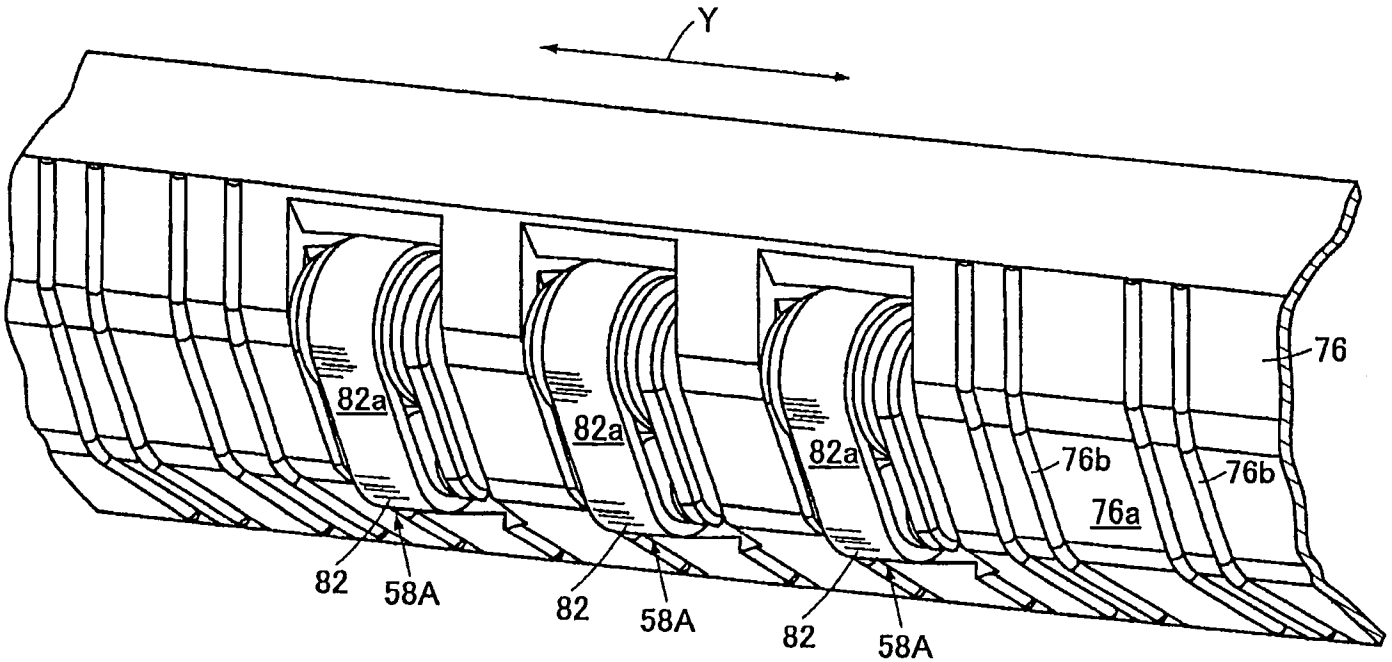
FIG. 3 is a perspective view of a major part of a state that a belt unit of a paper transfer apparatus of FIG. 2 is attached and assembled in a transfer guiding member, seen from a grip roller side.

As described above, in the belt transfer unit 104, the transfer surfaces 82*a* of the transfer belts 82 project from the apertures 76*c* of the transfer guiding member 76 by a predetermined distance (stages). By the biasing force of the pair of left and right springs 106, the upper pulleys 83 are biased in a direction of pivoting counterclockwise about the pulley axle 84*a*. As a result, the belt transfer surfaces 82*a* are pressed onto grip rollers which are not shown in FIG. 6 by a predetermined pressure through the pulleys 83. As shown in FIG. 3, a surface of the transfer guiding member 76, which faces the first transfer path P1 and the vertical transfer path P9, has the ribs 76*b* serving as guiding surfaces to reinforce the transfer guiding member 76 and guide the paper. The size of the ribs 76*b* projecting to the first transfer path P1 and the vertical transfer path P9 sides is formed smaller than the predetermined stage that the transfer surfaces 82*a* of the transfer belts 82 project from the guiding surface 76*a*. Therefore, the ribs 76*b* do not disturb the belt transfer surfaces 82*a* in guiding and transferring the paper.

As described above, according to this reference example, basic effects described below are obtained by providing the belt transfer units 58A. In addition, there are following advantages. The pulleys 83 and 84, the transfer belts 82, and the pulley axles 83*a* and 84*a* are temporarily mounted in the housing case 105, thereby the belt transfer unit 104 which can be easily attached and detached to/from the open-close guide 79 can be formed. Therefore, there are advantages and effects in that attachment and detachment of the belt transfer unit 104 become easy and the precision of maintenance and cleaning is improved. Moreover, mounting errors and tolerances for every transfer belt 82 are less than the belt transfer unit shown in FIGS. 1 through 4, 13, 14, and the like of the related Japanese application 1.

The belt transfer unit (8 and 8A) described in the related Japanese application 2 may be used in this reference example instead of the belt transfer unit 58A.

Next, movement of paper transferred through the manual transfer path P2 at the transfer guiding member 69, corresponding to the above difference, is additionally described with reference to FIGS. 7A to 7C.

Figure 7A:
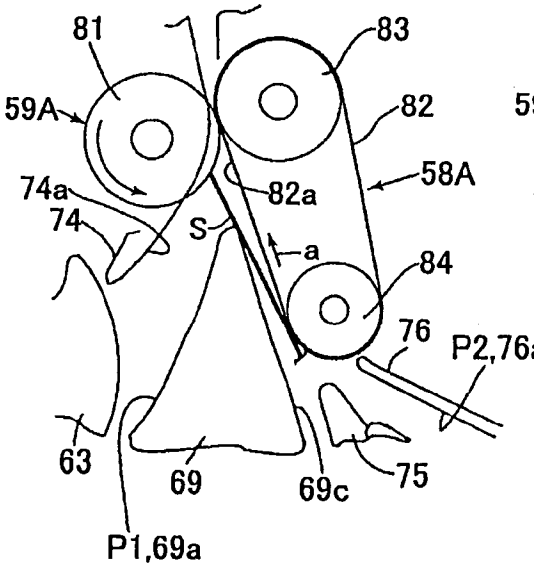
Related Art FIG.7A
FIGS. 7A to 7C are front views each showing a major part of the paper transfer apparatus of FIG. 2, for describing a movement of paper transferred to the transfer guiding member through a manual paper feed path.
Figure 7B:
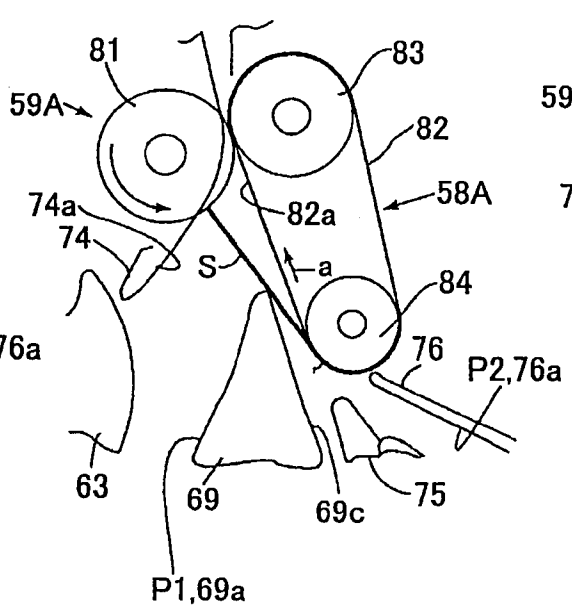
Related Art FIG.7B
Figure 7C:
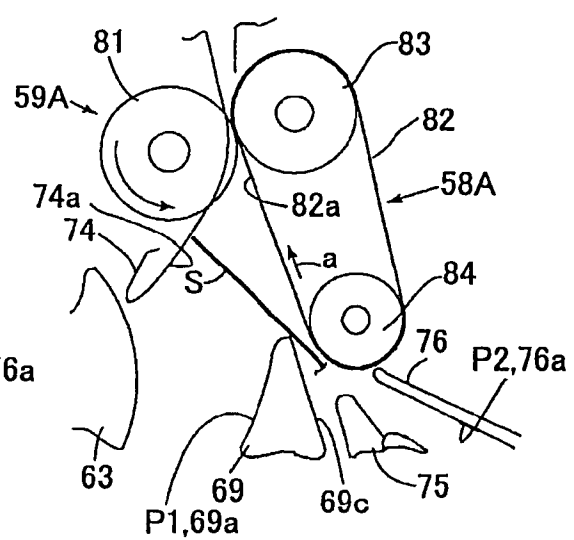
Related Art FIG.7C

FIGS. 7A to 7C show differences of positions that a leading edge of the paper S enters, when a downstream end of the transfer guiding member 69 is different in height and position. In FIG. 7A, the grip roller 81 is arranged on a straight line between the surface of the transfer belt 82 which is in contact with an outer surface or an outer periphery surface of the pulley 84, and the downstream end of the transfer guiding member 69. In this case, the paper S transferred through the second transfer path P2 moves as described below. When the leading edge of the paper S passes through the downstream end (a top guiding surface 69*c* in FIG. 7A) of the transfer guiding member 69, the paper S reaches a position as shown in FIG. 7A. At this time, the paper S reaches at an outer periphery surface of the grip roller 81 on a downstream side in the transfer direction of a straight line between a central axis of the grip roller 81 and a central axis of the pulley 84. Therefore, the leading edge of the paper S is guided by a rotation force of the grip roller 81 on a driving side to a nip part (nip point) N of the third transfer unit 59A.

Next, FIG. 7B is the same as FIG. 7A in that the grip roller 81 is provided on a straight line between the surface of the transfer belt 82 which is in contact with an outer surface or an outer periphery surface of the pulley 84, and the downstream end of the transfer guiding member 69. However, FIG. 7B is different from FIG. 7A in that the leading edge of the paper S reaches at a different position of the outer periphery surface of the grip roller 81. In this example, the paper S reaches the outer periphery surface of the grip roller 81 at a position on an upstream side in the transfer direction of a straight line between the central axis of the grip roller 81 and the central axis of the pulley 84. In this case, the leading edge of the paper S can be moved to the downstream side by the grip roller 81 as shown in FIG. 7A. However, since the surface of the paper S is transferred to the downstream side of the transfer direction by the belt transfer unit 58A, the paper S on the downstream side of a position where the surface of the paper S contacts the belt transfer unit 58 may generate waviness. Therefore, although the leading edge of the paper S can be guided to the nip part of the third transfer unit 59, it is preferable that the paper S reach the position of the grip roller 81 shown in FIG. 7A.

In FIG. 7C, the guiding surface 74*a* is provided at a position on an upstream side of the grip roller 81 and on an extension line of a line between the surface of the transfer belt 82 contacting the outer surface or the outer periphery surface of the pulley 84 and the downstream edge of the transfer guiding member 69. In this example, the paper S passes through the downstream end of the transfer guiding member 69 and reaches a position as shown in FIG. 7C. The guiding member 74*a* provided at such a position does not have a function to guide the leading edge of the paper S to the nip part of the third transfer unit 59A. Therefore, the transfer force of the feed roller 63A has to be increased to guide the leading edge of the paper S to the nip part of the third transfer unit 59A. Moreover, when the paper is soft, a leading edge of the paper is bent to the lower left side in the drawing. Thus, it becomes difficult to guide the paper to the nip part of the third transfer unit 59A. Therefore, it is preferable that the downstream edge of the transfer guiding member 69 be provided at the position shown in FIG. 7A, in which case the transfer force is not required to be increased for such soft paper.

As described above, the belt transfer unit 58 is provided as the outer surface of the combined transfer path P3 when seen from the first transfer path P1 and as the inner surface of the combined transfer path P3 when seen from the second transfer path P2, that is on the second transfer path P2 side. As a result, various types of paper can be transferred from both the first and second transfer paths P1 and P2.

Figure 9A:
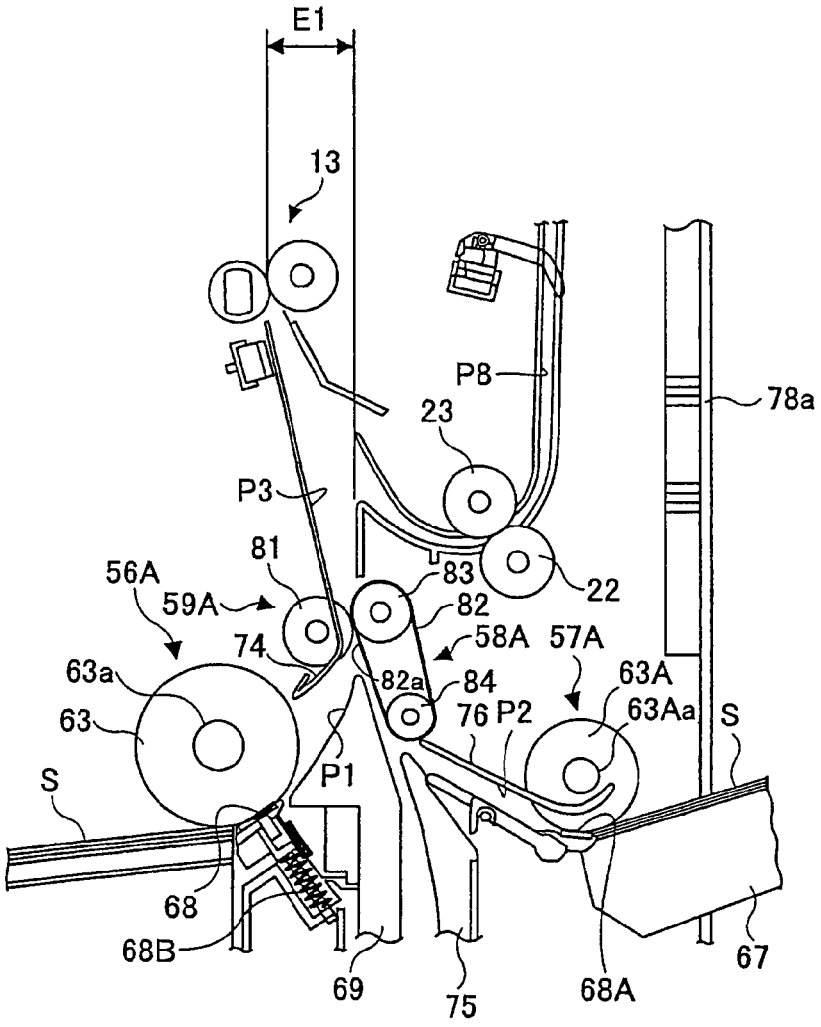
FIG. 9A is a front view of a major part of a paper transfer apparatus shown in FIG. 2 for describing that the paper transfer apparatus can be downsized.
Figure 9B:
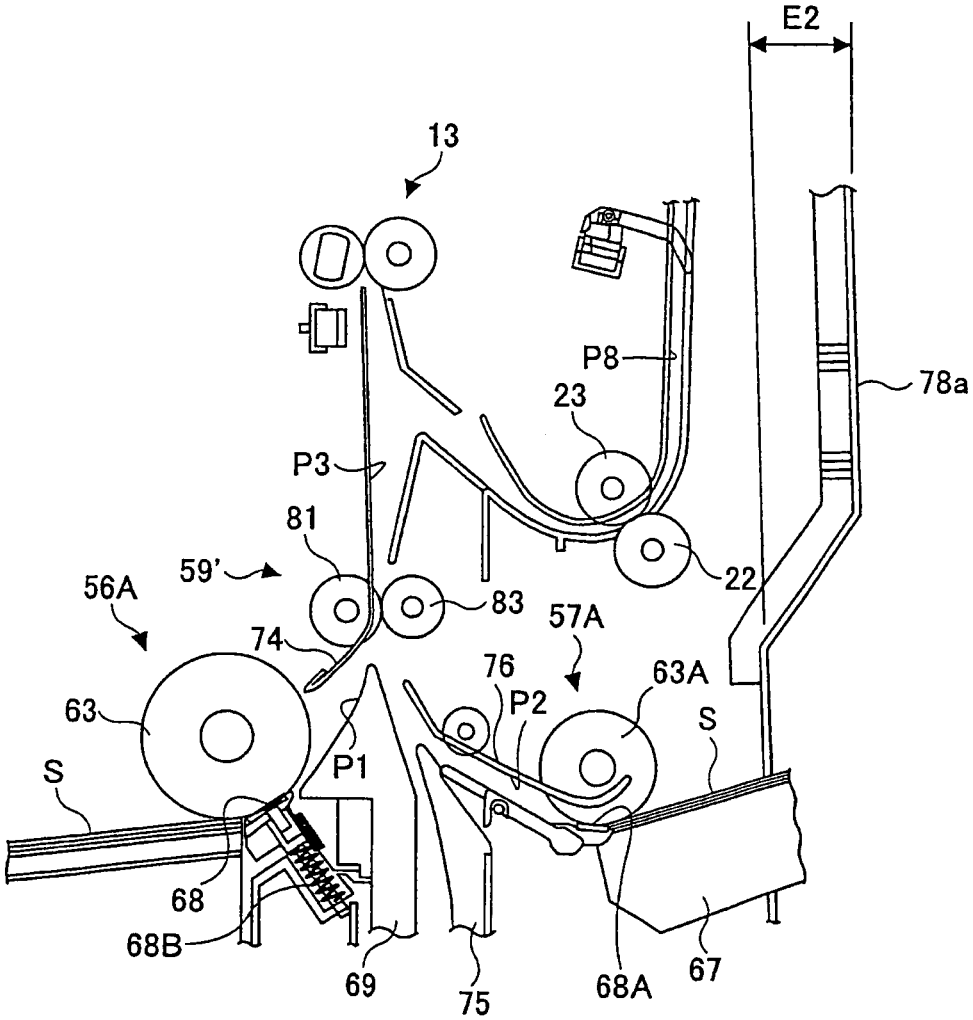
FIG. 9B is a front view of a major part of a conventional paper transfer apparatus as a comparison.

Further, by providing the belt transfer unit 58 as described above, one of the first and second transfer paths P1 and P2 can be more freely designed. FIGS. 9A and 9B show examples.

In FIGS. 9A and 9B, reference numeral 78*a* denotes an exterior package (exterior panel) of an apparatus body 78 on the manual paper feed unit side. In this reference example and conventional examples, when the manual tray 67 is not used, the manual tray 67 can be folded to the exterior package 78*a* side to be stored in the exterior package 78*a*, which is a well-known configuration. FIG. 9A shows this reference example, in which the belt transfer unit 58A included in the third transfer unit 59A is tilted to the left side in order to guide the paper in a direction of curving back to the transfer direction of the first transfer path P1. As a result, the combined transfer path P3 on the downstream side of the belt transfer unit 58A and the pair of resist rollers 13 can be shifted to the left side in the horizontal direction by a distance of E1. At the same time, the paper feed path P8 provided on the downstream side of the belt transfer unit 58 and the exterior package 78*a* can be shifted to the left side by the distance of E1. This space can be used for reducing the width of the apparatus and downsizing the apparatus.

FIG. 9B, on the other hand, shows the conventional example. In FIG. 9, the combined transfer path P3 on the downstream side of the third transfer unit 59' extends in a substantially vertical direction. At the same time, the paper refeed path P8 and the exterior package 78*a* are biased and protrude by a distance of E2=E1 to the right side in the horizontal direction in FIG. 9B.

To make the conventional configuration shown in FIG. 9B more compact, it is a general idea to combine the paper refeed unit P8 into a space right before the pair of resist rollers 13 to provide a combined transfer path. In the reference example shown in FIG. 9A, the curvature radius of the paper refeed path P8 is determined by a distance between the pair of resist rollers 13 and a double side transfer guiding member (near the right side of the exterior package 78*a*). Therefore, the paper refeed path P8 and the exterior package 78*a* can be shifted to the left side while keeping the curvature radius (larger the better) as a transfer quality of a double-sided sheet. As a result, the apparatus shown in FIG. 9B can be downsized by the distance of E2, which equals to E1.

As described above, according to the paper transfer apparatus 55 of the reference example, which corresponds to the first, second, and third embodiments of related Japanese application 2, the following effects are obtained by the following specific configurations.

That is, in the reference example, there is described the paper transfer apparatus 55 (sheet transfer apparatus, the same applies below) including the first transfer path P1 (first transfer channel, the same applies below) through which the paper S (sheet, the same applies below) is transferred; the second transfer path P2 (second transfer channel, the same applies below) through which the sheet is transferred from an opposite side of the first transfer path P1; a combined transfer path P3 (combined transfer channel, the same applies below)

into which the first transfer path P1 and the second transfer path P2 merge; and the belt transfer unit 58A provided as the outer surface of the combined transfer path P3 when seen from the first transfer path P1 in the combined transfer path P3, and as the inner surface of the combined transfer path P3 when seen from the second transfer path P2 in the combined transfer path P3, that is on the second transfer path P2 side.

According to the reference example, various types of paper S in various sizes can be transferred from both the first and second transfer paths P1 and P2 while downsizing the apparatus as compared to the conventional apparatus. Alternatively, various types of paper S can be transferred with stable transfer quality by increasing the curvature radius of one of the first transfer path P1 and the second transfer path P2, with the same apparatus width as the conventional apparatus width. As a result, the design freedom can be improved.

In the reference example, when the first transfer unit 56A (first counter transfer unit, the same applies below) which is provided on the upstream side of the first transfer path P1 and capable of transferring the paper S; the second transfer unit 57A (second counter transfer unit, the same applies below) which is provided on the upstream side of the second transfer path P2 and capable of transferring the paper S; and the third transfer unit 59A (nip transfer unit, the same applies below) which is provided on the downstream side and has a nip part N (nip point N) capable of nipping and transferring the paper S are provided. When the distance between the first transfer unit 56A and the second transfer unit 57A is constant in the apparatus width direction, the curvature radius of the second transfer path P2 can be set larger when the belt transfer unit 58A is provided than the case where the belt transfer unit 58A is not provided.

According to the reference example, the curvature radius of the second transfer path P2 can be increased while keeping the apparatus width similar to the conventional apparatus width. Therefore, various types of sheets can be transferred with stable transfer quality from the second transfer path P2.

In the reference example, the third transfer unit 59A which is provided on the downstream side of the combined transfer path P3 and forms the nip part N capable of nipping and transferring the paper S is provided. One of the opposing pair of the third transfer unit 59A is the grip roller 81 (rotation transfer driving unit, the same applies below) capable of transmitting a driving force by rotation. The other of the opposing pair of the third transfer unit 59A is the belt transfer unit 58A which is rotated following the grip roller 81 and includes the transfer belt 82 which adds the transfer force to the paper S by contacting the surface of the paper S transferred from the second transfer path P2 to the nip part N.

According to the reference example, by this configuration, the transfer belt 82 of the belt transfer unit 82A adds the transfer force to the paper S by contacting the surface of the paper S transferred from the second transfer path P2. Therefore, relatively firm paper (sheet) such as thick paper can be transferred with stable transfer quality.

In the reference example, the belt transfer unit 58A is provided so that the curvature radius of the first transfer channel is smaller than the curvature radius of the second transfer path P2.

According to the reference example, by providing the belt transfer unit 58A at an appropriate position, the curvature radius of the first transfer path P1 becomes smaller than the curvature radius of the second transfer path P2. The second transfer path P2 is often used for transferring various types of paper in various sizes which are manually fed and the like. Since the second transfer path P2 can have a larger curvature radius, relatively firm paper S (sheet) such as thick paper can be transferred with further stable transfer quality.

In the reference example, the belt transfer unit 58A is provided so as to guide the paper S in a direction of curving back to the paper (sheet) transfer direction of the first transfer path P1.

According to the reference example, with this configuration, the curvature radius of the second transfer path P2 can be set large. Therefore, various types of paper S in various sizes transferred from the second transfer path P2 can be transferred with further stable transfer quality.

In the reference example, the first transfer path P1 includes the transfer guiding members 69 and 74 configured to guide the leading edge of the paper S to enter the belt transfer unit 58A at an acute entering angle.

According to the reference example, with this configuration, relatively firm paper such as thick paper (for example, the paper S (sheet) of 256 to 300 g/m$^2$, which cannot be transferred conventionally) can be stably transferred from the first transfer path P1. In this manner, the configuration of the reference example includes the first transfer path P1, the first transfer unit 56A, the third transfer unit 59A, and the transfer guiding members 69 and 74, which are substantially similar to those in related Japanese application 1. As a result, it is needless to say that test results and effects similar to Example 1 shown in FIGS. 4 and 5 and described in paragraphs [0137] to [0147] of related Japanese application 1 are obtained.

In the reference example, the third transfer unit 59A which is provided on the downstream side of the combined transfer path P3 and which forms the nip part N capable of nipping and transferring the paper S is provided. One of the opposing pair of the third transfer unit 59A is the grip roller 81 (rotation transfer driving unit, the same applies below) capable of transmitting a driving force by rotation. The other of the opposing pair of the third transfer unit 59A is the belt transfer unit 58A which is rotated by following the grip roller 81 and includes the transfer belt 82 which adds the transfer force to the paper S by contacting the surface of the paper S transferred from the second transfer path P2 to the nip part N. The belt transfer unit 58A includes the pulley 83 in a roller shape (first belt holding rotation member, the same applies below) which faces the grip roller 81 with the transfer belt 82 interposed therebetween and rotates by following the grip roller 81, at least one pulley 84 (second belt holding rotation member, the same applies below) provided on the upstream side of the pulley 83 of the second transfer path P2, and the transfer belt 82 looped around the pulleys 83 and 84. The second transfer path P2 has an inner surface formed of the transfer guiding member having the guiding surface 76*a* configured to guide the paper S. On the upstream side of the pulley 84 in the second transfer path P2, the feed roller 63A (second counter transfer member, the same applies below) configured to transfer the paper S is provided. The guiding surface 76*a* is provided inside a tangential line between outer surface ends of the pulleys 83 and 84 and a tangential line between the outer surface end of the pulley 84 and the outer surface end of the feed roller 63A.

According to the reference example, with this configuration, the transfer belt 82 can be a substitute for a follower roller (not shown) which is conventionally provided in the second transfer path P2. As a result, the paper S transferred through the second transfer path P2 does not rasp with the guiding surface 76*a*. Therefore, the cause of damage, waviness, and the like of the paper S is eliminated.

In the reference example, the pulley 84 is provided so that the outer surface end of the pulley 84 and the guiding surface 76*a* of the transfer guiding member 76 form an obtuse angle.

According to the reference example, with this configuration, even a curled leading edge of the paper S is not folded or the like by contacting at the transfer belt 82. In this manner, the paper S can be transferred with stable transfer quality.

In the reference example, the third transfer unit (nip transfer unit) 59A which is provided on the downstream side of the first transfer path P1 and forms the nip part N capable of nipping and transferring the paper S is provided. One of the opposing pair of the third transfer unit 59A is the grip roller 81 (rotation transfer driving unit, the same applies below) which is capable of transmitting a driving force by rotation. The other of the opposing pair of the third transfer unit 59A is the belt transfer unit 58A having the transfer belt 82 which is rotated following the grip roller 81 and adds a transfer force to the paper S by contacting the surface of the paper S transferred from the second transfer path P2 to the nip part N. At least a part of the first transfer path P1 is formed of the belt transfer unit 58A and the transfer guiding member 69 facing the belt transfer unit 58A.

According to the reference example, with this configuration, transfer resistance generated when transferring relatively stiff and firm paper S (for example, the paper S (sheet) of 256 to 300 g/m$^2$, which cannot be transferred conventionally) such as thick paper can be reduced. As a result, transfer defects such as skewing and paper jam which are generated when transferring the paper S to the downstream side of the first transfer path P1 can be prevented in advance.

In the reference example, the printer 100 (image forming apparatus, the same applies below) includes the second transfer unit (manual paper feed unit) 57A which is provided on one side of the apparatus body and transfers the set paper S to the apparatus body. The second transfer unit (manual paper feed unit) 57A is provided on the second transfer path P2 side.

According to the reference example, the aforementioned effects are provided in the image forming apparatus having the second transfer unit (manual paper feed unit) 57A on the second transfer path P2 side.

In the reference example, the printer 100 includes the paper transfer apparatus 55; the image forming units 1Y, 1C, 1M, and 1Bk (image forming members, the same applies below) which are provided on the downstream side of the belt transfer unit 58A and capable of forming images on the paper S transferred through the belt transfer unit 58A; and the paper refeed path P8 (inversion transfer path, the same applies below) through which the front and back sides of the paper S, on which the images are formed by the image forming units 1Y, 1C, 1M, and 1Bk, are inverted. The paper refeed path P8 is provided to be combined to the second transfer path P2 side.

According to the reference example, the effect obtained by providing the paper transfer apparatus 55 is obtained in the image forming apparatus in which the paper refeed path P8 is combined to the second transfer path P2 side.

In the reference example, the printer 100 includes the paper transfer apparatus 55; the image forming units 1Y, 1C, 1M, and 1Bk which are provided on the downstream side of the belt transfer unit 58A and capable of forming images on the paper S transferred through the belt transfer unit 58A; and the paper refeed path P8 (inversion transfer path, the same applies below) through which the front and back sides of the paper S on which the images are formed by the image forming units 1Y, 1C, 1M, and 1Bk are inverted. The paper refeed path P8 is provided so as to be combined to the combined transfer path P3 on the downstream side of the belt transfer unit 58A.

According to the reference example, the effects obtained by providing the paper transfer apparatus 55 are obtained. In addition, relatively stiff paper S (for example, the paper S (sheet) of 256 to 300 g/m$^2$, which cannot be transferred conventionally) such as thick paper can be transferred without any problems to, for example, the pair of resist rollers 13 (resist units) provided on the image forming units 1Y, 1C, 1M, and 1Bk side, without increasing the size of the apparatus. At the same time, a wide distance and space can be provided between the combined transfer path P3 on the downstream side of the belt transfer unit 58A and the pair of resist rollers 13. This space can be used as a space in which the leading edge of the paper S is bent.

In the above description, the belt transfer unit 58A is provided in the second transfer path P2 to which the paper S is fed from the manual tray 67, however, other configurations may be employed as well. For example, the belt transfer unit (8B (8 and 8A)) can be provided as the inner surface of a position to change the transfer direction, such as the inner surface of the first transfer path (A) from the feed roller (63) of the paper feed apparatus (3) to the second transfer unit (7); an inner surface of a position to change the transfer direction of an inversion transfer path (R3).; an inner surface of a position to change the transfer direction in the automatic document feeder (ADF or ARDF); and the like, similarly as described in the first embodiment of the related Japanese application 2.

Figure 10:
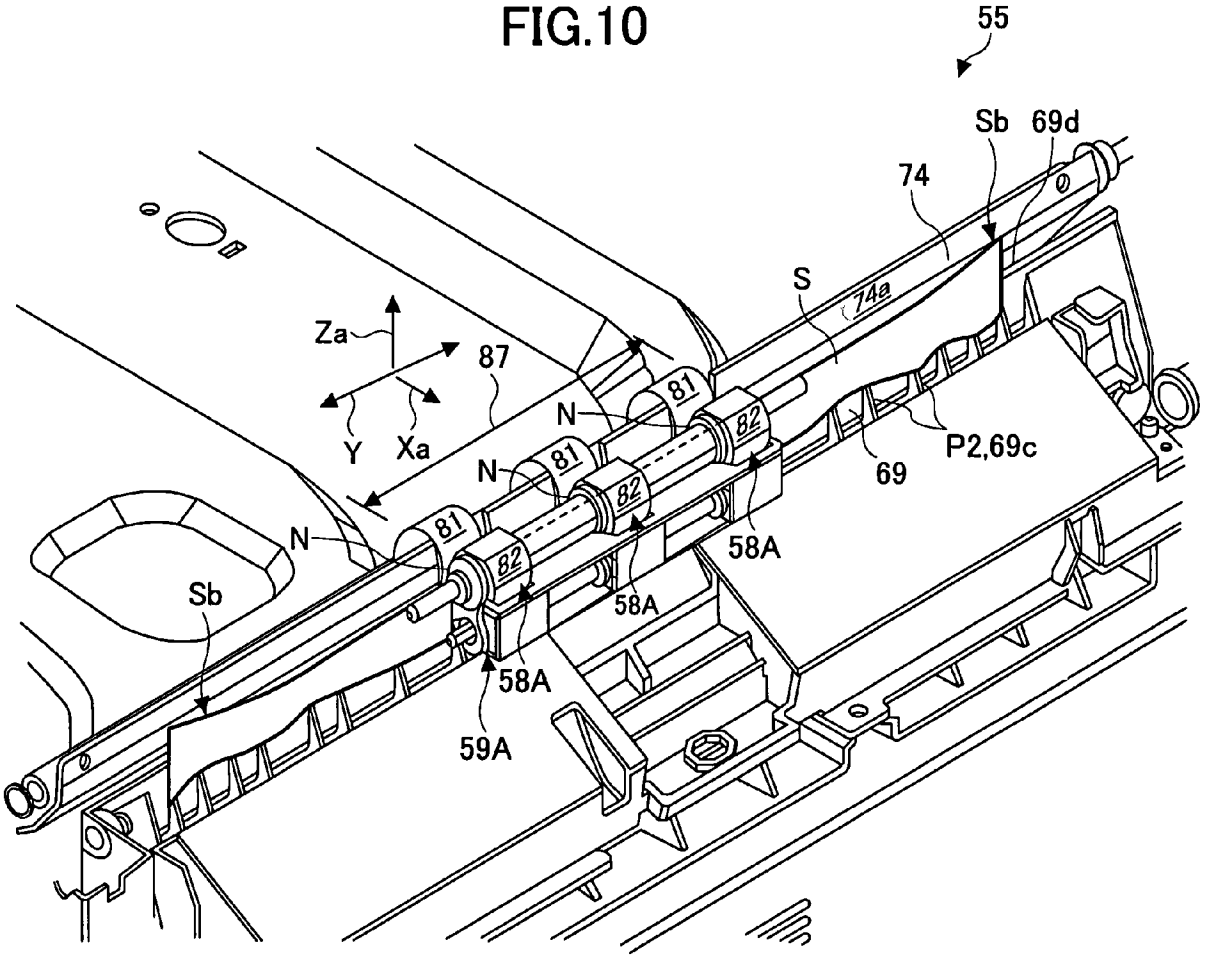
FIG. 10 is a perspective view of a major part of a paper transfer apparatus of a reference example, for describing conventional problems.

In the paper transfer apparatus 55 of the reference example shown in FIGS. 2 to 9, the problems to be improved, which are described in Description of the Related Art were found while conducting tests and the like to transfer various types of paper. These problems are described with reference to FIG. 10 showing the paper transfer apparatus 55 of the reference example. FIG. 10 shows the paper feed apparatus 55 of the reference example shown in FIG. 2, in which the transfer guiding member 76 forming the belt transfer unit 104 shown in FIG. 6 is removed, the three belt transfer units 58A are exposed, and the leading edge of the paper S transferred from the second transfer path P2 to the third transfer unit (nip transfer unit) 59A by the transfer guiding member 69 is easily seen. The transfer guiding member 69 is provided in favorable layout and shape shown in FIG. 7A.

In the paper feed apparatus 55 shown in FIGS. 2 to 9 and 10, there is a problem in that a downstream rear edge of relatively stiff paper S (for example, the paper S (sheet) of 256 to 300 g/m$^2$) such as thick paper transferred through the second transfer path P2 by the second transfer unit 57A generates waviness, is bent, or hung down with respect to the guiding surface 69*c* on both end sides of the paper in the paper width direction Y and outside the nip parts (nip points) N of the third transfer unit 59A, on a downstream side of the transfer guiding member 69 (first guiding member) provided at a position where the first transfer path P1 and the second transfer path P2 meet and guides the paper S transferred from the first transfer path P1 and the second transfer path P2 to the combined transfer path P3. Due to this, the paper S is stuck at the curved part of the transfer guiding member 74 and cannot be normally guided and transferred, causing transfer defects such as a paper jam, leading to unstable transfer operation. In FIG. 10, reference numeral 87 denotes an outermost area (hereinafter called "nip part outermost area") of the nip parts N of the third transfer unit 59A.

When a test to transfer the relatively stiff paper S (for example, the paper S (sheet) of 256 to 300 g/m$^2$) such as thick paper was repeated plural times, the problem shown in FIG. 10 was caused and the transfer defects were observed. However, when thin paper with relatively low stiffness or normal paper was used in the test, a transfer defect causing a paper jam was not generated. As a cause of the transfer defect, the following reasons are considered. The grip roller 81 is formed of relatively harder rubber and has a lower friction coefficient against the paper than the transfer belt 82 (when the nip part N is formed by the conventional grip roller 81 and the pulley 83 in a roller shape (transfer roller 83), the grip roller 81 and the pulley 83 are formed of a material with the same hardness in the case where the paper S is not changed in the transfer direction at the nip part N). That is, at a moment when the stiff paper S such as thick paper enters the nip parts N, the paper S twines and fits around the transfer belts 82 due to the stiffness of the paper S. Thus, the transfer force of the transfer belt 82 formed of rubber having a higher friction coefficient against the paper S becomes relatively lower than the transfer force of the grip roller 81. As a result, opposite ends in the paper width direction Y of the downstream rear edge of the paper S generate waviness or is bent outside the nip part outermost area 87.

In view of this, an embodiment and the like of the present invention are described below with a focus on the problem that the opposite ends of the downstream rear edge of the paper S (for example, the paper S (sheet) of 256 to 300 g/m$^2$) in the paper width direction Y generate waviness or is bent outside the nip part outermost area 87 at the position of the downstream edge 69*d* of the transfer guiding member 69 provided in the combined transfer path P3. Further, the transfer guiding member 69 is used to solve the problem with the simplest and inexpensive structure.

(First Embodiment)

Figure 11:
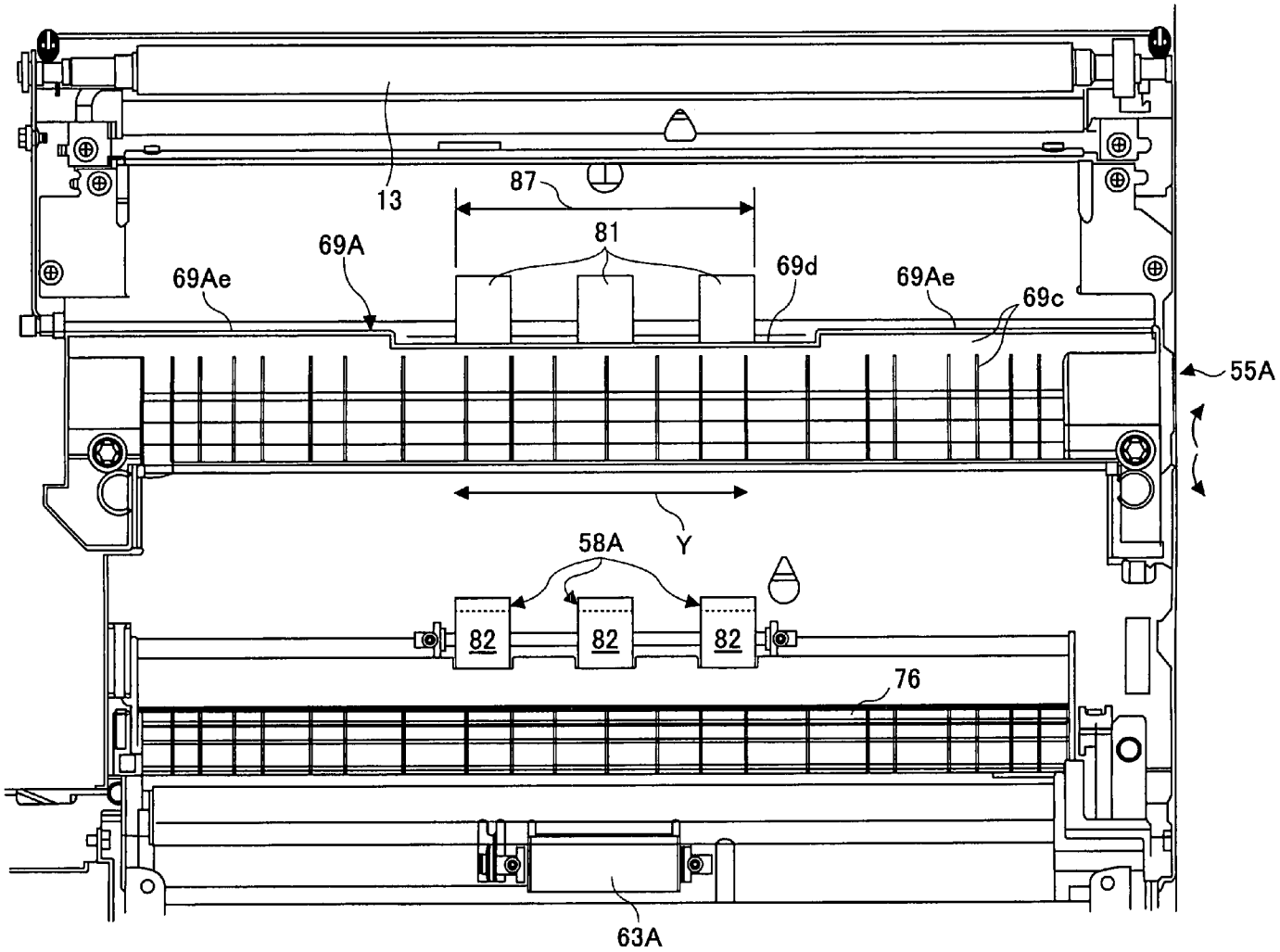
FIG. 11 is a right side view showing a major configuration around a paper transfer apparatus of a first embodiment.

A first embodiment of the present invention is described with reference to FIGS. 11 to 13. FIG. 11 is a right side view of a part of a paper transfer apparatus 55A, which corresponds to the paper transfer apparatus 55 shown in FIG. 2. The frame F is opened about the rotation axle Fa shown in FIG. 1, the open-close guide 79 shown in FIG. 2 is opened, and the grip roller 81 and the belt transfer unit 58A are separated and opened.

In the first embodiment, as shown in FIG. 11, the paper transfer apparatus 55A including a transfer guiding member 69A instead of the paper transfer apparatus 55 including the transfer guiding member 69 of the reference example shown in FIGS. 2 to 9. The paper transfer apparatus 55A is similar to the printer 100 (see FIG. 1) having the paper transfer apparatus 55 shown in FIGS. 2 to 9 other than this difference.

Figure 12:
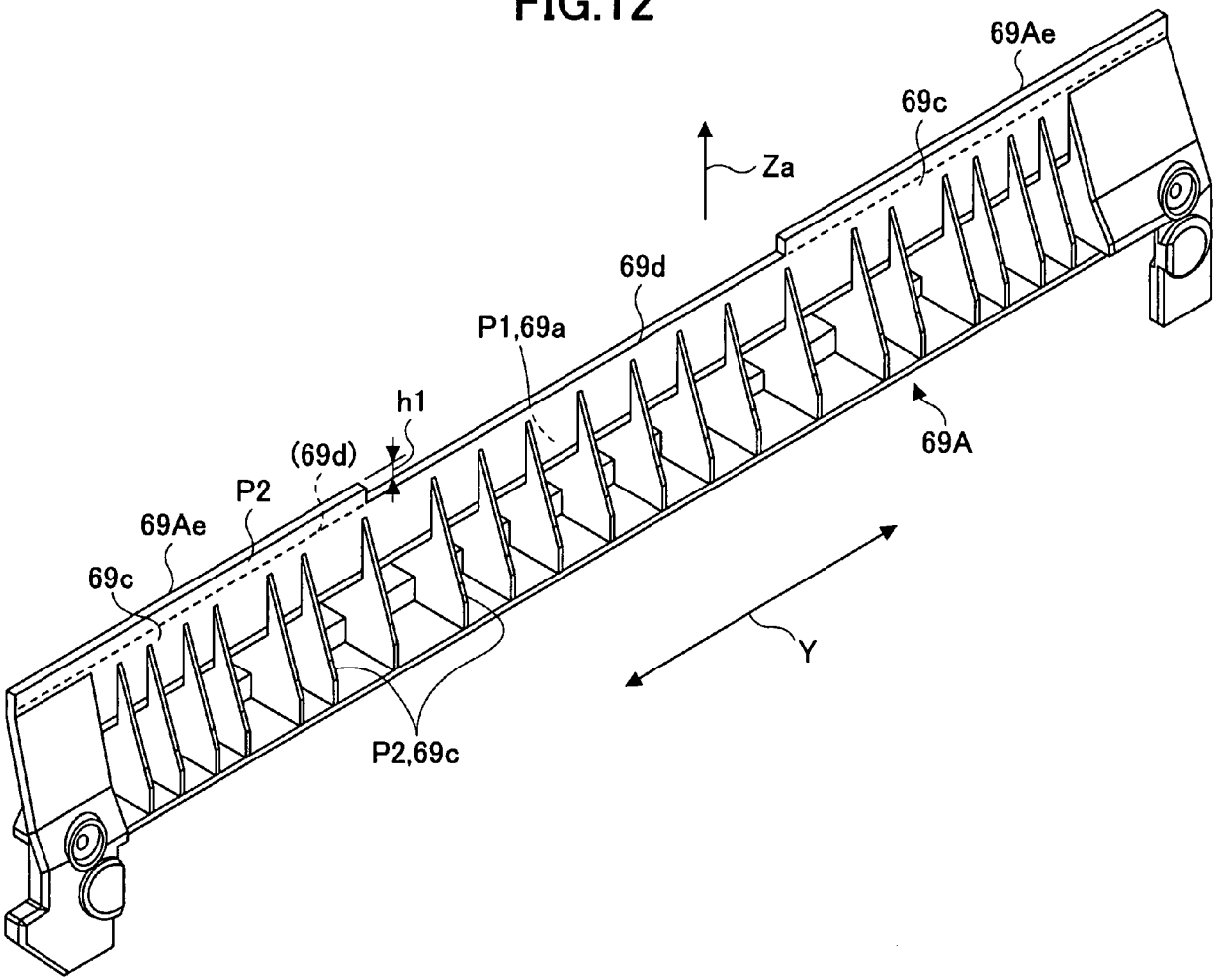
FIG. 12 is a perspective view showing a transfer guiding member of a first embodiment.
Figure 13:
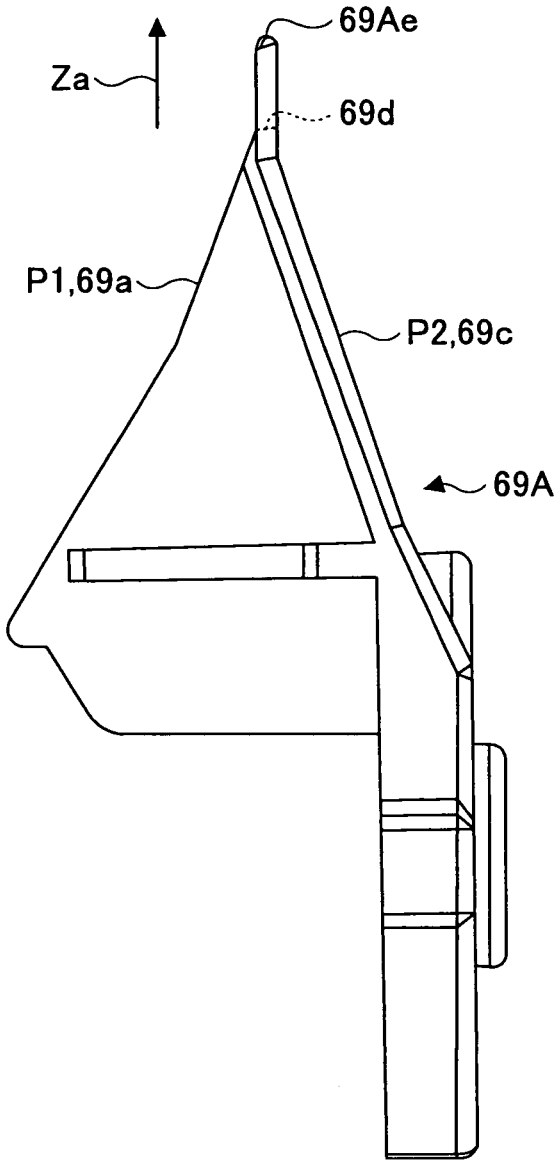
FIG. 13 is a front view of a transfer guiding member of FIG. 12.

As shown in FIGS. 11 to 13, the transfer guiding member 69A serving as a first guiding member is different from the transfer guiding member 69 of the reference example only in the following point. The transfer guiding member 69A has a shape in which downstream edges 69Ae of the transfer guiding member 69A which is not facing the nip parts N where the first and second transfer paths P1 and P2 meet are provided on a downstream side in a paper transfer direction Za of the position of the downstream edge 69d of the transfer guiding member 69A facing the nip parts N (the same position as the downstream edge 69d in the paper transfer direction Za of the transfer guiding member 69 of the reference example). Other than this difference, the transfer guiding member 69A is similar to the transfer guiding member 69 shown in FIG. 2 and the like.

Here, "the transfer guiding member 69A which is not facing the nip parts N" means the transfer guiding member 69A which is not facing the nip part outermost area 87 in this embodiment. Further, "the transfer guiding member 69A facing the nip parts N" means the transfer guiding member 69A facing the nip part outermost area 87 in this embodiment.

The downstream edge 69*d* of the transfer guiding member 69 of the reference example in the paper transfer direction Za is formed to have a straight edge, extending in the paper width direction Y having the same level in the paper transfer direction Za (see (69*d*) in FIG. 12).

This difference is specifically described with reference to FIGS. 11 to 13. The downstream edges 69Ae of the transfer guiding member 69A in the paper transfer direction Za, which are not facing the nip part outermost area 87 where the first transfer path P1 and the second transfer path P2 meet, are formed to extend longer than the downstream edge 69*d* in the paper transfer direction Za of the transfer guiding member 69 by a length of about h1 to the downstream side in the paper transfer direction Za. The length of hi is set in a range of about several millimeters to 10 millimeters though depending on the type of the sheet to be used.

Since the transfer guiding member 69A of this embodiment has the downstream edges 69Ae in the paper transfer direction Za, which are not facing the nip part outermost area 87 where the first transfer path P1 and the second transfer path P2 meet, formed longer by the length of about h1 to the downstream side of the paper transfer direction Za than the downstream edge 69*d* in the paper transfer direction Za of the transfer guiding member 69, the downstream edges 69Ae serve as appropriate guides. Therefore, even when relatively stiff paper S (for example, the paper S (sheet) of 256 to 300 g/m$^2$) such as thick paper or special paper is transferred from the second transfer path P2 to the combined transfer path P3 with small curvature radiuses of the curved parts of the transfer paths, waviness and bending of opposite ends of the downstream edge of the paper S in the paper width direction Y outside the nip part outermost area 87 are straightened and guided even with a space saving design with a small curvature radius of the transfer path. Then, the paper S is normally transferred to the downstream side of the combined transfer path P3 by the third transfer unit 59A. Therefore, a transfer defect such as a paper jam can be prevented in advance, which drastically reduces transfer defects.

Moreover, a transfer defect such as a paper jam can be prevented in advance even when different types of sheets are used and waviness is caused. As a result, transfer defects are drastically reduced.

Here, the first embodiment is more briefly described. The first guiding member (transfer guiding member 69A) at which the first transfer path (first transfer path P1) and the second transfer path (second transfer path P2) meet, has parts which are not facing the nip parts N (parts which are not facing the nip part outermost area 87) and a part facing the nip parts N (a part facing the nip part outermost area 87), which are provided at different positions in the sheet transfer direction (paper transfer direction Za).

Here, the expression that "the first guiding member (transfer guiding member 69A) has parts which are not facing the nip parts N (parts which are not facing the nip part outermost area 87) and a part facing the nip parts N (a part facing the nip part outermost area 87), which are provided at different positions in the sheet transfer direction (paper transfer direction Za)" has a broad concept including that the downstream edge of the first guiding member (transfer guiding member 69A) may have a depression, a protrusion, a knurling, a relief, and the like to some extent if the downstream edge of the first guiding member is at a position and has a shape which can solve the problems of the present invention, that is, which can reduce transfer defects such as a paper jam.

In this embodiment, the transfer guiding member 69A and the downstream edges 69Ae are formed of, for example, a molded resin in an integrated manner. Therefore, the transfer guiding member 69A can be substantially formed of one component inexpensively. However, if this advantage is not required much, for example, the downstream edges 69Ae may be separately formed and then fixed by an appropriate bonding unit such as a screw or an adhesive, or by way of thermal sealing or the like.

(Deformation Example 1 of the First Embodiment)

FIG. 14 shows a deformation example 1 of the first embodiment. In the deformation example 1, instead of the paper transfer apparatus 55A including the transfer guiding member 69A of the first embodiment, a paper transfer apparatus 55B including a transfer guiding member 69B instead of the transfer guiding member 69A is used as shown in FIG. 14. Other than this difference, the deformation example 1 is similar to the printer 100 (see FIG. 1) including the paper transfer apparatus 55A shown in FIGS. 11 to 13.

The transfer guiding member 69B serving as a first guiding member is different from the transfer guiding member 69A of the first embodiment in the following point. A downstream edge 69Be of the transfer guiding member 69B which does not face the nip parts N where the first transfer path P1 and the second transfer path P2 meet, has a shape extending to the downstream side in the paper transfer direction Za with an inclination being gradually higher toward the opposite ends of the paper width direction Y (h2>h1). Other than this difference, the transfer guiding member 69B is similar to the transfer guiding member 69A shown in FIGS. 11 to 13.

By using the transfer guiding member 69B of this deformation example, a similar effect to the transfer guiding member 69A of the first embodiment can be obtained. Moreover, various types of sheets in various sizes and stiffness can be used.

Figure 15:
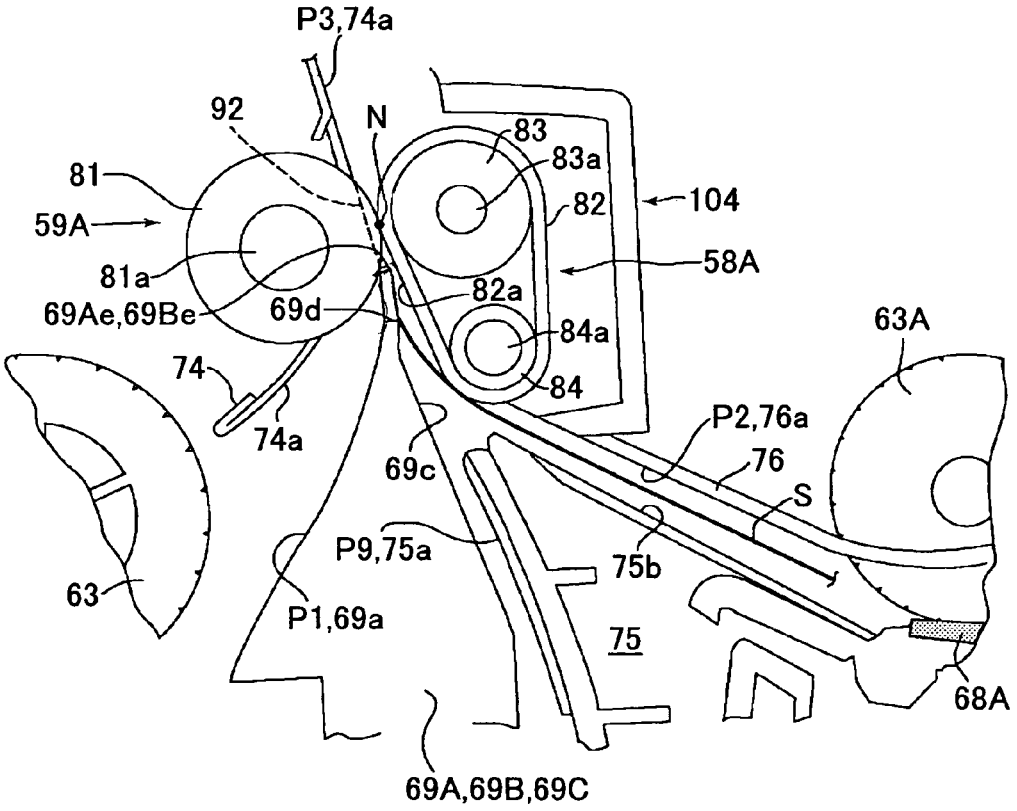
FIG. 15 is a front view showing a major part of a paper transfer apparatus of a first embodiment and the like for further describing an effect of a transfer guiding member.

The transfer guiding member 69A of the first embodiment and the transfer guiding member 69B of the deformation example 1 are further described with reference to FIG. 15.

The downstream edges 69Ae and 69Be of the transfer guiding members 69A and 69B respectively, which are not facing the nip parts N of the third transfer unit 59A, are provided at positions so that a leading edge of the paper S transferred through the second transfer path P2 is guided to an end part of the curved part of the transfer guiding member 76. As a result, the paper S transferred through the second transfer path P2 can be transferred to the downstream side of the combined transfer path P3 with more stable transfer quality.

Moreover, the downstream edges 69Ae and 69Be of the transfer guiding members 69A and 69B respectively, which are not facing the nip parts N of the third transfer unit 59A, are provided on an imaginary extension line 92 (a dotted line in FIG. 15) extending to the upstream side of a guiding surface 74*a* of the transfer guiding member 74. As a result, the paper S transferred through the second transfer path P2 can be transferred to the downstream side of the combined transfer path P3 with more stable transfer quality. This can be applied to a transfer guiding member 69C of a second embodiment described below.

(Second Embodiment)

Figure 16:
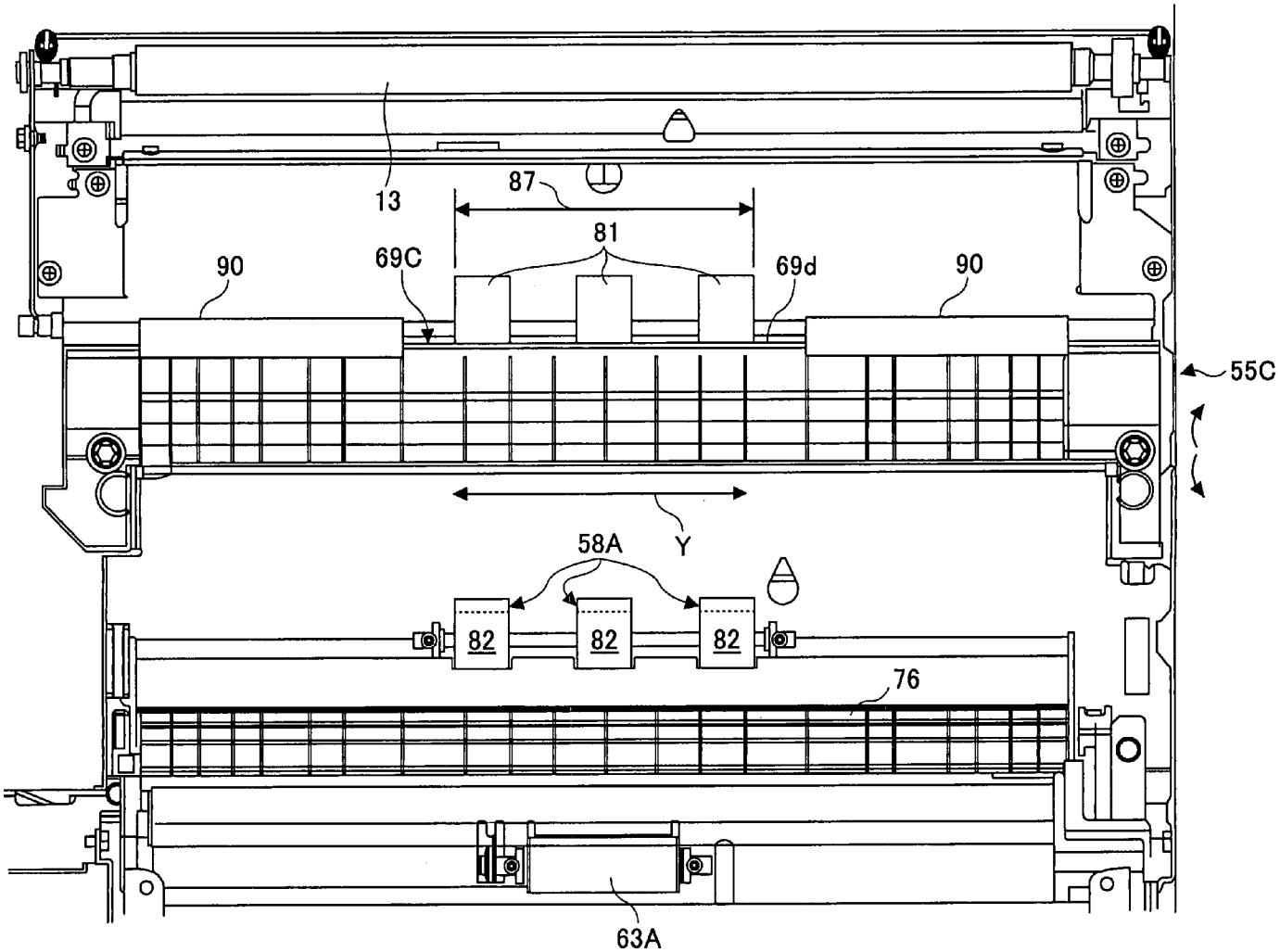
FIG. 16 is a right side view showing a major configuration around a paper transfer apparatus of a second embodiment.
Figure 17:
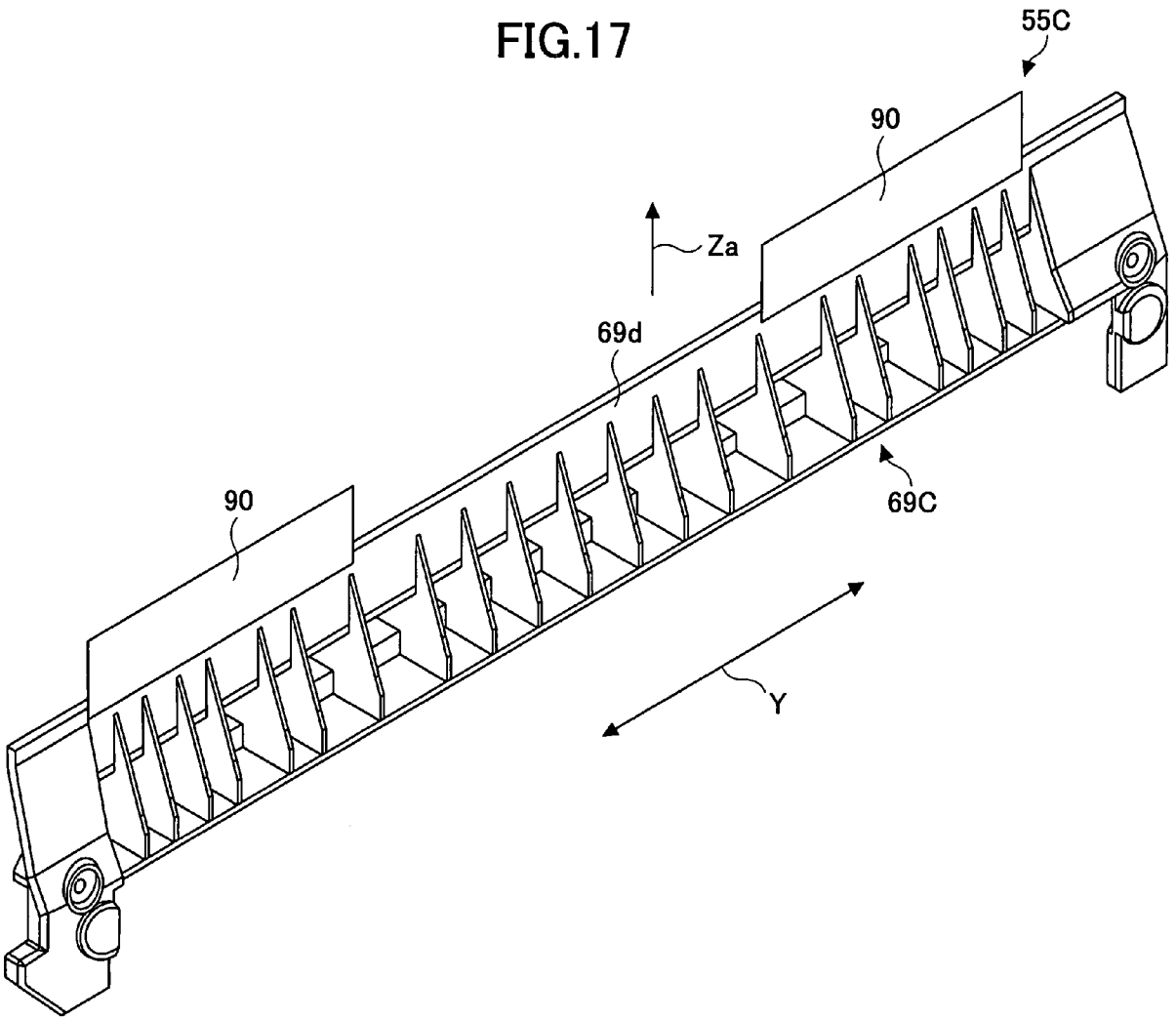
FIG. 17 is a perspective view showing a transfer guiding member of a second embodiment.
Figure 18:
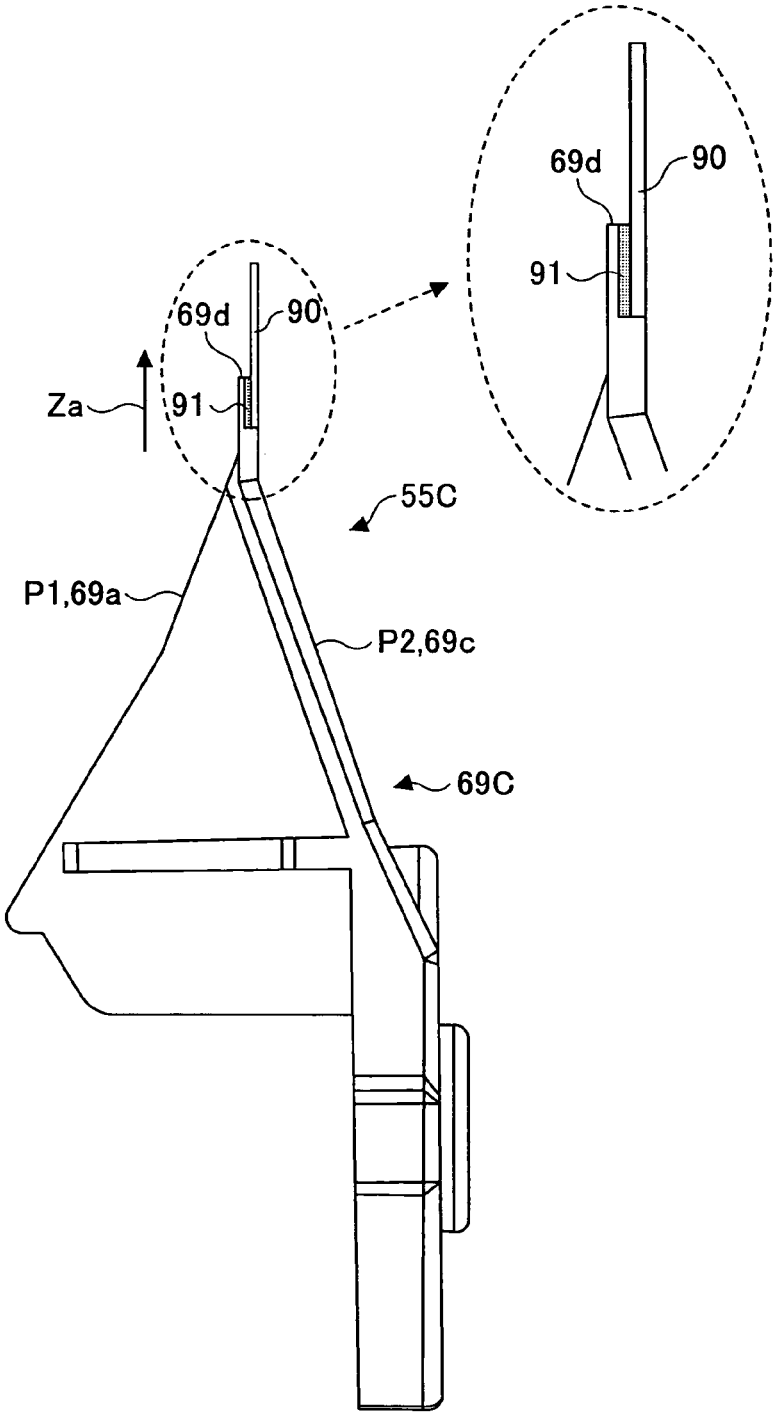
FIG. 18 is a front view of a transfer guiding member shown in FIG. 17.

The second embodiment of the present invention is described with reference to FIGS. 16 to 18. FIG. 16 is a right side view of the paper transfer apparatus shown in FIG. 2, in which the frame F is opened about the rotation axle Fa shown in FIG. 1, the open-close guide 79 shown in FIG. 2 is opened, and the grip roller 81 and the belt transfer unit 58A are separated and opened.

In the second embodiment, instead of the paper transfer apparatus 55 including the transfer guiding member 69 of the reference example shown in FIGS. 2 to 9, a paper transfer apparatus 55C including the transfer guiding member 69C instead of the transfer guiding member 69 is used as shown in FIG. 16. Other than this difference, the paper transfer apparatus 55C of the second embodiment is similar to the printer 100 (see FIG. 1) having the paper transfer apparatus 55 shown in FIGS. 2 to 9.

The transfer guiding member 69C serving as a first guiding member is different from the transfer guiding member 69 of the reference example in that the transfer guiding member 69C has mylar sheets 90 at positions which are not facing the nip parts N where the first transfer path P1 and the second transfer path P2 meet. The mylar sheets 90 serve as flexible members capable of elastic deformation by contacting the paper S transferred from the second transfer path P2. Other than this difference, the transfer guiding member 69C is similar to the transfer guiding member 69 shown in FIG. 2 and the like.

The mylar sheet 90 is a thin sheet with low stiffness and appropriate thickness, formed of polyethylene terephthalate (PET) and the like. The mylar sheets 90 are adhered and fixed below the downstream edges 69*d* of the transfer guiding member 69C with a double-stick tape 91.

Here, the "transfer guiding member 69C which is not facing the nip parts N" means the transfer guiding member 69C which is not facing the nip part outermost area 87 in this embodiment. Moreover, the "transfer guiding member 69C facing the nip parts N" means the transfer guiding member 69C facing the nip part outermost area 87 in this embodiment.

The aforementioned difference is more simply described. As shown in FIGS. 16 to 18, the mylar sheets 90 are used at the downstream edge parts in the paper transfer direction Za of the transfer guiding member 69C which is not facing the nip part outermost area 87 where the first transfer path P1 and the second transfer path P2 meet. Downstream edges of the mylar sheets 90 in the paper transfer direction Za are extended to the downstream side in the paper transfer direction Za to be longer than the downstream edges 69*d* of the paper transfer direction Za of the transfer guiding member 69. The downstream edges in the paper transfer direction Za of the mylar sheets 90 are normally extended to the downstream side in the paper transfer direction Za to be longer than the length h1 of the downstream edge 69Ae of the transfer guiding member 69A of the first embodiment.

According to the transfer guiding member 69C of this embodiment, the mylar sheets 90 which have low stiffness are used as flexible members capable of elastic deformation when contacting the paper S transferred from the second transfer path P2, and are attached to the downstream edges of the transfer guiding member 69C, which are not facing the nip part outermost area 87 where the first transfer path P1 and the second transfer path P2 meet. Therefore, in the case of using a highly stiff member, transfer resistance can be reduced since the mylar sheets 90 extending to the downstream side of the transfer guiding member 69C have flexibility. Even in an apparatus with a space-saving design in which the transfer paths have small curvature radiuses at curved parts, when relatively stiff paper S (for example, 256 to 300 g/m$^2$) such as thick paper or special paper is transferred from the second transfer path P2 to the combined transfer path P3, waviness and bending at opposite ends of the downstream edge of the paper S in the paper width direction Y outside the nip part outermost area 87 are straightened and guided to be normally transferred by the third transfer unit 59A to the downstream side of the combined transfer path P3. Therefore, a transfer defect such as a paper jam can be prevented in advance and transfer defects can be drastically reduced.

Further, even when various types of waviness of various types of sheets have occurred, a transfer defect such as a paper jam can be prevented in advance. As a result, transfer defects can be drastically reduced.

(Third Embodiment)

Figure 19:
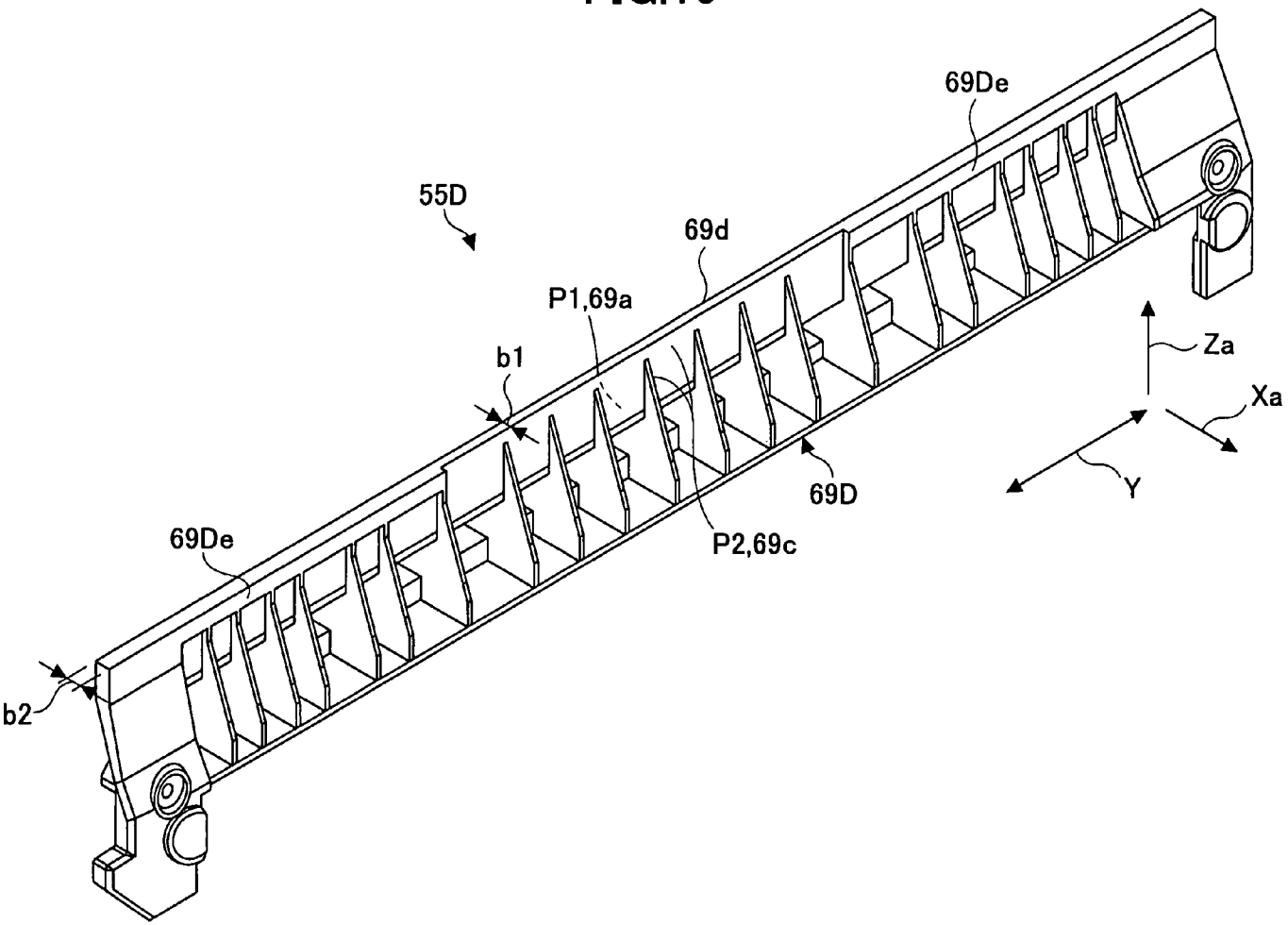
FIG. 19 is a perspective view showing a transfer guiding member in a paper transfer apparatus of a third embodiment.

A third embodiment of the present invention is described with reference to FIG. 19. In the third embodiment, instead of the paper transfer apparatus 55 including the transfer guiding member 69 of the reference example shown in FIGS. 2 to 9, a paper transfer apparatus 55D including a transfer guiding member 69D is used instead of the transfer guiding member 69 as shown in FIG. 19. Other than this difference, the third embodiment is similar to the printer 100 (see FIG. 1) including the paper transfer apparatus 55 shown in FIGS. 2 to 9.

The transfer guiding member 69D serving as a first guiding member 1 is different from the transfer guiding member 69 of the reference example in that a guiding surface 69De serving as a guiding surface of a downstream edge in the paper transfer direction Za of the transfer guiding member 69D for guiding the paper S transferred through the second transfer path P2 is provided at different positions in a direction Xa vertically crossing the paper transfer direction Za, between parts which are not facing the nip parts N of the third transfer unit 59A and a part facing the nip parts N, to have different thicknesses of b1 and b2 respectively in a direction Xa vertically crossing the paper transfer direction Za. Other than this difference, the transfer guiding member 69D is similar to the transfer guiding member 69 shown in FIG. 2 and the like.

Here, the "transfer guiding member 69D which is not facing the nip parts N" means the transfer guiding member 69D which is not facing the nip part outermost area 87 (see FIG. 10 and the like) in this embodiment. Further, the "transfer guiding member 69D facing the nip parts N" means the transfer guiding member 69D facing the nip part outermost area 87 (see FIG. 10 and the like) in this embodiment.

Here, "a guiding surface 69De serving as a guiding surface of a downstream edge in the paper transfer direction Za of the transfer guiding member 69D has different shapes in a direction Xa vertically crossing the paper transfer direction Za, between parts which are not facing the nip parts N of the third transfer unit 59A and a part facing the nip parts N" has a broad concept including that the guiding surface 69De of the downstream edge of the first guiding member (transfer guiding member 69D) may have a depression, a protrusion, a knurling, a relief, and the like to some extent if the guiding surface 69De is at a position and has a shape which can solve the problems of the present invention, that is, which can reduce transfer defects such as a paper jam.

The aforementioned difference is described in detail with reference to FIG. 19. The transfer guiding member 69D has guiding surfaces 69De at the downstream edges of the paper transfer direction Za, at parts which are not facing the nip part outermost area 87 (see FIG. 10 and the like) of the third transfer unit 59A. The guiding surfaces 69De are extended in the Xa direction from the position of the guiding surface 69*c* of the transfer guiding member 69D facing the nip part outermost area 87. When a thickness in the Xa direction of the guiding surface 69*c* of the conventional transfer guiding member 69 is b1, a thickness b2 in the Xa direction of the guiding surface 69*c* of the transfer guiding member 69D is thicker than b1 (b2>b1).

The length of extension (b2−b1) of the transfer guiding member 69 in the Xa direction is set in a range of about several millimeters to 10 millimeters though depending on a type of a sheet to be used.

According to the transfer guiding member 69D of this embodiment, the transfer guiding member 69D has the guiding surfaces 69De on the downstream edge in the paper transfer direction Za at parts which are not facing the nip part outermost area 87 (see FIG. 10 and the like) of the third transfer unit 59A. The guiding surfaces 69De extend longer in the Xa direction than the guiding surface 69*c* of the transfer guiding member 69D facing the nip part outermost area 87. As a result, a sheet can be properly guided. Even in an apparatus with a space-saving design in which the transfer paths have small curvature radiuses at curved parts, when relatively stiff paper S (for example, 256 to 300 g/m$^2$) such as thick paper or special paper is transferred from the second transfer path P2 to the combined transfer path P3, waviness and bending at opposite ends of the downstream edge of the paper S in the paper width direction Y outside the nip part outermost area 87 are straightened and guided to be normally transferred to the downstream side of the combined transfer path P3 by the third transfer unit 59A. Therefore, a transfer defect such as a paper jam can be prevented in advance and transfer defects can be drastically reduced.

Further, even when various types of waviness of various types of sheets are occurred, a transfer defect such as a paper jam can be prevented in advance. As a result, transfer defects can be drastically reduced.

In this embodiment, the transfer guiding member 69D and the guiding surface 69De are formed of, for example, a molded resin in an integrated manner. Therefore, the transfer guiding member 69D can be substantially formed of one component inexpensively. However, if this advantage is not required much, for example, the downstream edges 69De may be separately formed and then fixed by an appropriate bonding unit such as a screw or an adhesive, or by way of thermal sealing or the like.

(Deformation Example 2 of the Third Embodiment)

Figure 20:
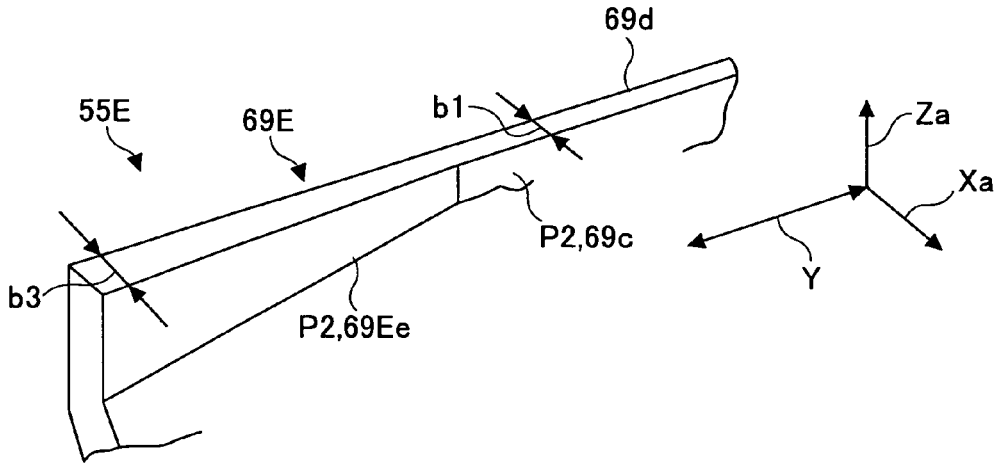
FIG. 20 is a perspective view showing a major part of a transfer guiding member of a paper transfer apparatus of a deformation example 2.

FIG. 20 shows a deformation example 2 of the third embodiment. In the deformation example 2, instead of the paper transfer apparatus 55D including the transfer guiding member 69D of the third embodiment, a paper transfer apparatus 55E including a transfer guiding member 69E instead of the transfer guiding member 69D is used as shown in FIG. 20. Other than this difference, the deformation example 2 is similar to the printer 100 (see FIG. 1) including the paper transfer apparatus 55D shown in FIG. 19.

The transfer guiding member 69E serving as a first transfer guiding member is different from the transfer guiding member 69D of the third embodiment in that each guiding surface 69Ee of a downstream edge in the paper transfer direction Za of the transfer guiding member 69D which is not facing the nip part outermost area 87 (see FIG. 10 and the like) of the third transfer unit 59A, has a shape which is inclined to be gradually thicker in the Xa direction toward the opposite ends in the paper width direction Y (b3>b2>b1). Other than this difference, the transfer guiding member 69E is similar to the transfer guiding member 69D shown in FIG. 19.

By using the transfer guiding member 69E of this deformation example, a similar effect to the effect of the transfer guiding member 69D of the third embodiment can be obtained. Moreover, various types of sheets in various sizes and stiffness can be used.

(Fourth Embodiment)

Figure 21:
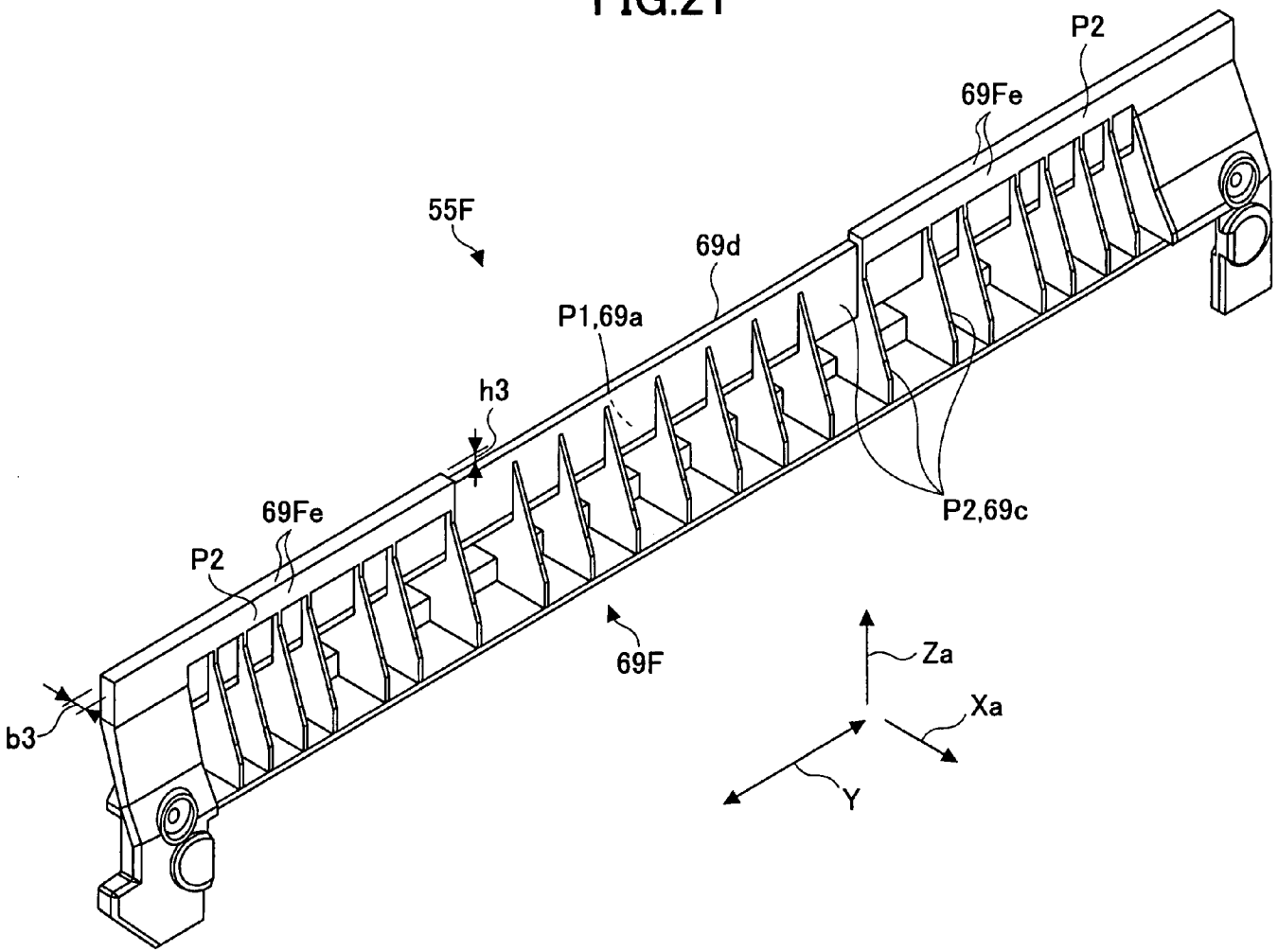
FIG. 21 is a perspective view showing a transfer guiding member of a paper transfer apparatus of a fourth embodiment.

A fourth embodiment of the present invention is described with reference to FIG. 21. In the fourth embodiment, a paper transfer apparatus 55F including a transfer guiding member 69F formed by the combination of the transfer guiding member 69A of the first embodiment shown in FIGS. 11 to 13 and the transfer guiding member 69D of the third embodiment shown in FIG. 19, is provided. Other than this difference, the fourth embodiment is similar to the printer 100 (see FIG. 1) including the paper transfer apparatus 55 shown in FIGS. 2 to 9.

The transfer guiding member 69F serving as a first guiding member corresponds to a combination of the transfer guiding member 69A of the first embodiment shown in FIGS. 11 to 13 and the transfer guiding member 69D of the third embodiment shown in FIG. 19. As shown in FIG. 21, downstream edges 69Fe in the paper transfer direction Za of the transfer guiding member 69F which is not facing the nip part outermost area 87 (see FIG. 11) where the first transfer path P1 and the second transfer path P2 meet, are formed to extend longer to the downstream side in the paper transfer direction Za than the downstream edge 69*d* in the paper transfer direction Za of the conventional transfer guiding member 69 by a length of about h3 (h3<h1). Moreover, guiding surfaces 69Fe are formed to extend longer in the Xa direction than the guiding surface 69*c* of the transfer guiding member 69F facing the nip part outermost area 87 (b3<b2).

Therefore, the downstream edges 69Fe of the transfer guiding member 69F do not extend to the downstream side in the paper transfer direction Za as long as the length h1 of the downstream edge 69Ae in the paper transfer direction Za of the transfer guiding member 69A of the first embodiment. Moreover, the guiding surfaces 69Fe of the downstream edge in the paper transfer direction Za of the transfer guiding member 69F do not extend as thick as the thickness b2 of the guiding surface 69De of the downstream edge in the paper transfer direction Za of the transfer guiding member 69D of the third embodiment. Therefore, the transfer guiding member 69F has functions of both the guiding members 69A and 69D.

The transfer guiding member 69F of this embodiment has effects of the transfer guiding member 69A of the first embodiment and the transfer guiding member 69D of the third embodiment. By appropriately employing the guiding members 69A and 69D when there is a restriction in design or the like, design freedom can be expanded.

As described above, a transfer guide can be formed by the combination of the deformation example 1 shown in FIG. 14 and the deformation example 2 shown in FIG. 20.

As described above, the belt transfer unit 58A included in the paper transfer apparatuses 55A to 55F is an example of a moving guide unit which keeps a state that a leading edge or a leading edge part (a broad term including a leading edge, a leading edge surface, a corner of the leading edge, an edge, and the like) of paper S transferred from the first transfer path P1 is in contact with one of the opposing pair of rollers forming the third transfer unit (nip transfer unit) 59A, and moves and guides the paper S to a nip part (nip point) formed with the grip roller 81 while gradually expanding the contact area depending on the stiffness of the paper.

In the first to fourth embodiments, a friction pad method is employed as the separation paper feed unit (paper feed separation mechanism), however, this does not limit the embodiments and other methods may be employed as well. An appropriate friction separation method may be employed as long as stacked sheets are separated by friction and only one sheet is transferred in a transfer direction. For example, a separation claw and the like may be used for the feed roller instead of using the friction pad.

The sheet transfer apparatus of the present invention can be applied to image forming apparatuses such as printers including a monochrome multifunction peripheral, a monochrome laser printer, a monochrome inkjet printer, a printer using a printer ribbon, and the like, in addition to the color printer. The sheet transfer apparatus of the present invention can be similarly applied to tandem type color image forming apparatuses employing a direct transfer method, by which a transfer body sends a sheet and sequentially transfers and overlaps images onto the sheet, and an image forming apparatus having a single photoreceptor of an endless belt type. Moreover, the present invention may be applied to a sheet transfer apparatus which transfers and supplies a sheet from a sheet storage unit (paper feed tray) or a sheet stack unit (paper feed stage) to a printing unit body in a printing machine including a stencil printing machine and the like.

Furthermore, the present invention may be applied to image forming apparatuses including not only a copying machine, but also to a multifunction peripheral and the like including a facsimile machine, a printer, an inkjet recording apparatus, a printing apparatus, and the like or a combination of at least two of these. In any cases, the present invention provides an optimal sheet transfer apparatus for devices and apparatuses, in which various types of sheets as various types of paper can be transferred, the space is saved on the transfer paths of the sheet, and a transfer direction of the sheet is required to be changed.

That is, the present invention may be an image forming apparatus having the sheet transfer apparatus described in any one of the claims.

According to one embodiment, a novel sheet transfer apparatus and an image forming apparatus having the sheet transfer apparatus are provided by solving the aforementioned problems.

Specific effects of each claim of the present invention are described below. That is, according to one embodiment, the first guiding member which is not facing the nip part where the first transfer path and the second transfer path meet is provided on the downstream side in the sheet transfer direction of a position of the first guiding member facing the nip part where the first transfer path and the second transfer path meet. Therefore, a guiding member capable of appropriately guiding various waviness of various types of sheets in parts other than the nip part can be formed. Therefore, a highly stiff sheet such as thick paper and special paper can be transferred even with a space-saving design with the second transfer path having the curved part with a small curvature radius. Thus, a sheet transfer apparatus with high quality, in which there are quite a bit less paper jams and transfer defects, can be realized and provided.

According to one embodiment, a flexible member capable of elastic deformation when contacted by a sheet transferred from the second transfer path is used for the first guiding member which is not facing the nip parts where the first and second transfer paths meet. By using a member with low stiffness such as PET as a material of the flexible member, transfer resistance can be reduced as compared to the case of using a highly stiff member, since portions extending on the downstream side in the sheet transfer direction of the first guiding member are flexible. Therefore, a highly stiff sheet such as thick paper and special paper can be transferred even with a space-saving design with the second transfer path having the curved part with a small curvature radius. As a result, a sheet transfer apparatus with high quality, in which there are quite a bit less paper jams and transfer defects, can be realized and provided.

According to one embodiment, the first guiding member which is not facing the nip parts where the first transfer path and the second transfer path meet and the first guiding member facing the nip parts where the first transfer path and the second transfer path meet are provided at different positions in the sheet transfer direction. Therefore, a guiding member capable of appropriately guiding various waviness of various types of sheets in parts other than the nip part can be formed. Thus, a highly stiff sheet such as thick paper and special paper can be transferred even with a space-saving design with the second transfer path having the curved part with a small curvature radius. As a result, a sheet transfer apparatus with high quality, in which there are quite a bit less paper jams and transfer defects, can be realized and provided.

According to one embodiment, the first guiding member has a guiding surface of a downstream edge in the sheet transfer direction for guiding a sheet transferred through the second transfer path. The guiding surface has a part which is not facing the nip parts and a part facing the nip parts. These parts of the guiding surface are provided at different positions in a direction vertically crossing the sheet transfer direction. Therefore, a guiding member capable of appropriately guiding various waviness of various types of sheets in parts other than the nip part can be formed. Thus, a highly stiff sheet such as thick paper and special paper can be transferred even with a space-saving design with the second transfer path having the curved part with a small curvature radius. As a result, a sheet transfer apparatus with high quality, in which there are quite a bit less paper jams and transfer defects, can be realized and provided.

According to one embodiment, the first guiding member has guiding surfaces which are not facing the nip parts, which is extended longer in a direction vertically crossing the sheet transfer direction than a guiding surface facing the nip parts. Therefore, a guiding member capable of appropriately guiding various waviness of various types of sheets in parts other than the nip part can be formed. Thus, a highly stiff sheet such as thick paper and special paper can be transferred even with a space-saving design with the second transfer path having the curved part with a small curvature radius. As a result, a sheet transfer apparatus with high quality, in which there are quite a bit less paper jams and transfer defects, can be realized and provided.

According to one embodiment, an image forming apparatus having an effect of the sheet transfer apparatus of at least one embodiment can be obtained by including a sheet transfer apparatus according to at least one embodiment and an image forming unit provided on a downstream side of a belt transfer unit and configured to form an image on a sheet transferred through the belt transfer unit.

Although the invention has been described with respect to specific embodiments for a complete and clear disclosure, the appended claims are not to be thus limited to the embodiments, deformation examples, and the like but are to be construed as embodying all modifications and alternative constructions that may occur to one skilled in the art that fairly fall within the basic teachings herein set forth, and the embodiments, deformation examples, and the like may be appropriately combined.

This patent application is based on Japanese Priority Patent Application No. 2008-011711 filed on Jan. 22, 2008, the entire contents of which are hereby incorporated herein by reference.

What is claimed is:

1. A sheet transfer apparatus comprising:

a first transfer unit configured to transfer a sheet and provided on an upstream side of a first transfer path through which the sheet is transferred;

a second transfer unit configured to transfer another sheet and provided on an upstream side of a second transfer path through which said another sheet is transferred from an opposite side of the first transfer path;

a third transfer unit provided on a combined transfer path into which the first transfer path and the second transfer path merge, the third transfer unit being configured to transfer the sheet transferred from the first transfer path and said another sheet transferred from the second transfer path to a downstream side of the combined transfer path in a sheet transfer direction; and a first guiding member provided at a position where the first transfer path and the second transfer path meet, the first guiding member being configured to guide the sheet transferred from the first transfer path and said another sheet transferred from the second transfer path to the combined transfer path, wherein the third transfer unit is configured to form a nip part by a pair of rotating members for transferring the sheet and said another sheet, one of the pair of rotating members being on a side of the second transfer path being a belt transfer unit, and the first guiding member has a downstream edge extending in a sheet width direction perpendicular to the sheet transfer direction, the downstream edge having a first edge part of a continuous straight edge extending in the sheet width direction and having the same level in the sheet transfer direction, the first edge facing the nip part and a second edge part not facing the nip part, the second edge part being situated on a downstream side of the first edge part and on an upstream side of the nip part in the sheet transfer direction, the first edge part and the second edge part meeting at an area outside of a nip part outermost area in the sheet width direction.

2. The sheet transfer apparatus as claimed in claim 1, further comprising:

a second guiding member spaced apart from the first guiding member and configured to guide said another sheet to the combined transfer path and serve as one surface of the second transfer path, the one surface being provided on an opposite side of the belt transfer unit; and a third guiding member spaced apart from the first and second guiding members and which has a curved end part on a downstream side and is configured to guide said another sheet to the combined transfer path and serve as the other surface of the second transfer path at a position facing the second guiding member, wherein the first edge part is situated so that a leading edge of said another sheet is guided to the curved end part.

3. The sheet transfer apparatus as claimed in claim 1, further comprising:

a fourth guiding member which extends from the downstream side to an upstream side of the combined transfer path so as to face the nip part and which guides the sheet and said another sheet transferred through the combined transfer path to the downstream side, wherein the first edge part is situated on an imaginary extension line extending from the fourth guiding member to the upstream side.

4. The sheet transfer apparatus as claimed in claim 1, wherein the third transfer unit in the sheet width direction perpendicular to the sheet transfer direction is discontinuously provided in the sheet width direction so as to contact a part of the sheet and said another sheet in the sheet width direction.

5. The sheet transfer apparatus as claimed in claim 4, wherein the third transfer unit is discontinuously formed in the sheet width direction so as to contact a central part of the sheet and said another sheet.

6. The sheet transfer apparatus as claimed in claim 1, wherein the other of the pair of rotating members is a rotation transfer driving unit capable of transmitting a driving force by rotation to the one of the pair of rotating members, and the one of the pair of rotating members is the belt transfer unit having a belt which moves by following the rotation of the rotation transfer driving unit to apply a transfer force to said another sheet transferred from the second transfer path to the nip part by contacting a surface of said another sheet.

7. The sheet transfer apparatus as claimed in claim 1, wherein the second edge part has a shape extending to the downstream side in the paper transfer direction with an inclination being gradually higher toward the opposite end of the first edge part.

8. The sheet transfer apparatus as claimed in claim 1, wherein the first edge part is within boundaries of an outmost area of the nip part and the second edge part is outside of the boundaries of the outermost area of the nip part.

9. The sheet transfer apparatus as claimed in claim 1, wherein all of the first edge part faces the nip part and all of the second edge part does not face the nip part.

10. An image forming apparatus comprising:

the sheet transfer apparatus as claimed in claim 1; and an image forming unit which is provided on a downstream side of the belt transfer unit and forms an image on the sheet and said another sheet transferred through the belt transfer unit.

* * * * *